US008317306B2

(12) United States Patent
Hattori

(10) Patent No.: US 8,317,306 B2
(45) Date of Patent: Nov. 27, 2012

(54) LIQUID CARTRIDGE DETERMINATION SYSTEMS AND LIQUID CARTRIDGE DETERMINATION METHODS

(75) Inventor: Shingo Hattori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 729 days.

(21) Appl. No.: 12/126,543

(22) Filed: May 23, 2008

(65) Prior Publication Data

US 2008/0291251 A1 Nov. 27, 2008

(30) Foreign Application Priority Data

May 25, 2007 (JP) ..... 2007-139291

(51) Int. Cl.
*B41J 2/175* (2006.01)
*B41J 2/17* (2006.01)

(52) U.S. Cl. ..... 347/86; 347/84; 347/85

(58) Field of Classification Search ..... 347/84–86
See application file for complete search history.

(56) References Cited

U.S. PATENT DOCUMENTS

| | | | | |
|---|---|---|---|---|
| 7,121,655 | B2 | 10/2006 | Silverbrook | |
| 2003/0137568 | A1* | 7/2003 | Shinada et al. | 347/86 |
| 2004/0179056 | A1 | 9/2004 | Katayama | |
| 2005/0157027 | A1* | 7/2005 | Silverbrook et al. | 347/40 |
| 2005/0157102 | A1* | 7/2005 | Silverbrook | 347/85 |
| 2005/0270342 | A1* | 12/2005 | Ogura et al. | 347/85 |
| 2007/0070146 | A1* | 3/2007 | Hattori et al. | 347/86 |
| 2007/0229620 | A1* | 10/2007 | Yano | 347/86 |

FOREIGN PATENT DOCUMENTS

| | | |
|---|---|---|
| JP | 2004-268519 A | 9/2004 |
| JP | 2006159707 A | 6/2006 |
| JP | 2007-069541 A | 3/2007 |

OTHER PUBLICATIONS

Japan Patent Office, Notice of Reasons for Rejection for Japanese Patent Application No. 2007-139291 (counterpart to above-captioned patent application), mailed Apr. 17, 2012.

Patent Reexamination Board of the Chinese Patent Office, Notification of Reexamination for Chinese Patent Application No. 200810109141.1 (counterpart Chinese patent application), issued Jul. 5, 2012.

* cited by examiner

*Primary Examiner* — Charlie Peng
*Assistant Examiner* — Hung Lam
(74) *Attorney, Agent, or Firm* — Baker Botts L.L.P.

(57) ABSTRACT

A liquid cartridge determination system includes a liquid cartridge including a main body including a first detect portion. The system also includes a movable member positioned outside the liquid chamber and configured to move relative to the main body in a particular direction. The movable member includes a second detect portion. Moreover, the system includes a resilient member having a first end which is coupled to the main body and a second end which is coupled to the movable member, and a mounting portion configured to receive the liquid cartridge thereon. The system further includes a first detector configured to detect the first detect portion when the liquid cartridge is positioned in a first position relative to the mounting portion, a second detector configured to detect the second detect portion when the liquid cartridge is positioned in a second position relative to the mounting portion, and a determiner configured to determine whether the liquid cartridge has a predetermined characteristic associated therewith based on the detection of the first detect portion and the detection of the second detect portion.

12 Claims, 14 Drawing Sheets

LIQUID CARTRIDGE DETERMINATION SYSTEMS AND LIQUID CARTRIDGE DETERMINATION METHODS

CROSS-REFERENCE TO RELATED APPLICATION

The present application claims priority from Japanese Patent Application No. JP-2007-139291, which was filed on May 25, 2007, the disclosure of which is incorporated herein by reference in its entirety.

BACKGROUND OF THE INVENTION

1. Field of the Invention

The present invention relates generally to liquid cartridge determination systems and liquid cartridge determination methods. In particular, the present invention is related to liquid cartridge determination systems and liquid cartridge determination methods which determine whether a particular liquid cartridge has at least one predetermined characteristic associated therewith, e.g., whether the ink cartridge includes a defect.

2. Description of Related Art

A known inkjet recording apparatus is configured to record an image on a sheet of paper with ink. This known inkjet recording apparatus has a recording head, and the recording head has a plurality of nozzles formed therein. The recording head is configured to selectively eject ink from the nozzles, such that the image is formed on the sheet of paper.

The known inkjet recording apparatus also has a mounting portion to which a known ink cartridge is removably mounted. The known ink cartridge has an ink chamber, an ink supply portion, and an air intake portion. The ink chamber is configured to store ink therein, and when the ink cartridge is mounted to the mounting portion, ink is supplied from the ink chamber to the recording head via the ink supply portion while air is introduced into the ink chamber via the air intake portion.

Another known ink cartridge has a case configured to store ink therein, and an operation member pivotably coupled to the case. The known ink cartridge is configured to be mounted to a mounting portion formed with a recording head. The known ink cartridge has an urging member positioned between the case and the operation member, and the case and the operation member are coupled via the urging member. The operation member has connecting portions, and the connecting portions contact the case, such that the operation member pivots about the connecting portions between a first position and a second position. When the ink cartridge is mounted to the mounting portion, a first end of the operation member latches on to a first portion of the mounting portion, and then the operation member is pressed by a user, such that the operation member pivots from the first position to the second position while the urging member contracts. In accordance with the pivotal movement of the operation member from the first position to the second position, the connecting portions move toward the recording head, which causes the case to move toward the recording head. Subsequently, a second end of the operation member latches on to a second portion of the mounting portion, which completes the mounting of the ink cartridge to the mounting portion.

Nevertheless, the urging member may be inadvertently omitted when the ink cartridge is assembled. In such a case, the ink cartridge may not be mounted to the mounting portion completely, which may cause ink leakage between the ink cartridge and the mounting portion or may cause image recording failure. Moreover, a defective urging member may be loaded to the ink cartridge when the ink cartridge is assembled. Furthermore, the urging member, the operation member, or the case may be deformed by an impact that the ink cartridge receives when the ink cartridge is shipped from a factory or when the ink cartridge is dropped. When this occurs, the operation member may be locked in the first position or the second position, which may cause ink leakage between the ink cartridge and the mounting portion or may cause image recording failure. When the ink cartridge is packed in a packaging bag, and the interior of the packaging bag is depressurized, the operation member may be deformed, such that the operation member is locked in the first position or the second position. This may cause ink leakage between the ink cartridge and the mounting portion or may cause image recording failure.

SUMMARY OF THE INVENTION

Therefore, a need has arisen for liquid cartridge determination systems and liquid cartridge determination methods which overcome these and other shortcomings of the related art. A technical advantage of the present invention is that whether a particular liquid cartridge has at least one predetermined characteristic associated therewith, may be determined, e.g., whether the ink cartridge has a defect.

According to an embodiment of the present invention, a liquid cartridge determination system comprises a liquid cartridge comprising a main body having a liquid chamber defined therein. The liquid chamber is configured to store liquid therein, and the main body comprises a first detect portion. The system also comprises a movable member positioned outside the liquid chamber and configured to move relative to the main body in a particular direction. The movable member comprises a second detect portion. Moreover, the system comprises a resilient member having a first end which is coupled to the main body and a second end which is coupled to the movable member, in which the resilient member is configured to contract to move the movable member relative to the case in the particular direction, and a mounting portion configured to receive the liquid cartridge thereon, in which the liquid cartridge is configured to be inserted into the mounting portion in the particular direction. The system further comprises a first detector configured to detect the first detect portion when the liquid cartridge is positioned in a first position relative to the mounting portion, a second detector configured to detect the second detect portion when the liquid cartridge is positioned in a second position relative to the mounting portion, in which the first position is different than the second position, and a determiner configured to determine whether the liquid cartridge has at least one predetermined characteristic associated therewith based on the detection of the first detect portion by the first detector and the detection of the second detect portion by the second detector. For example, the at least one predetermined characteristic may comprise at least one defect associated with the liquid cartridge.

According to another embodiment of the present invention, a liquid cartridge determination method comprises the step of detecting a first detect portion of a main body of an liquid cartridge when the liquid cartridge is positioned in a first position relative to a mounting portion to which the liquid cartridge is mounted, in which the main body has an liquid chamber defined therein, and the liquid chamber is configured to store liquid therein. The method also comprises the step of detecting a second detect portion of a movable member of the liquid cartridge when the liquid cartridge is positioned in a second position relative to the mounting portion, in which the movable member is coupled to the main body via a resilient member, and the first position is different from the second position. Moreover, the method comprises the step of determining whether the liquid cartridge has at least one predetermined characteristic associated therewith based on the detection of the first detect portion and the detection of the second detect portion. For example, the at least one predetermined characteristic may comprise at least one defect associated with the liquid cartridge.

Other objects, features, and advantages of embodiments of the present invention will be apparent to persons of ordinary skill in the art from the following description of preferred embodiments with reference to the accompanying drawings.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

FIGS. 13(*c*) and 13(*d*) are an exemplary time profile of a signal level of a signal outputted the optical sensor and an exemplary time profile of an ON/OFF state of the limit switch, respectively, when a second ink cartridge is mounted to the cartridge mounting portion.

DETAILED DESCRIPTION OF EMBODIMENTS

Embodiments of the present invention and their features and technical advantages may be understood by referring to FIGS. 1-14, like numerals being used for like corresponding portions in the various drawings.

Figure 1:
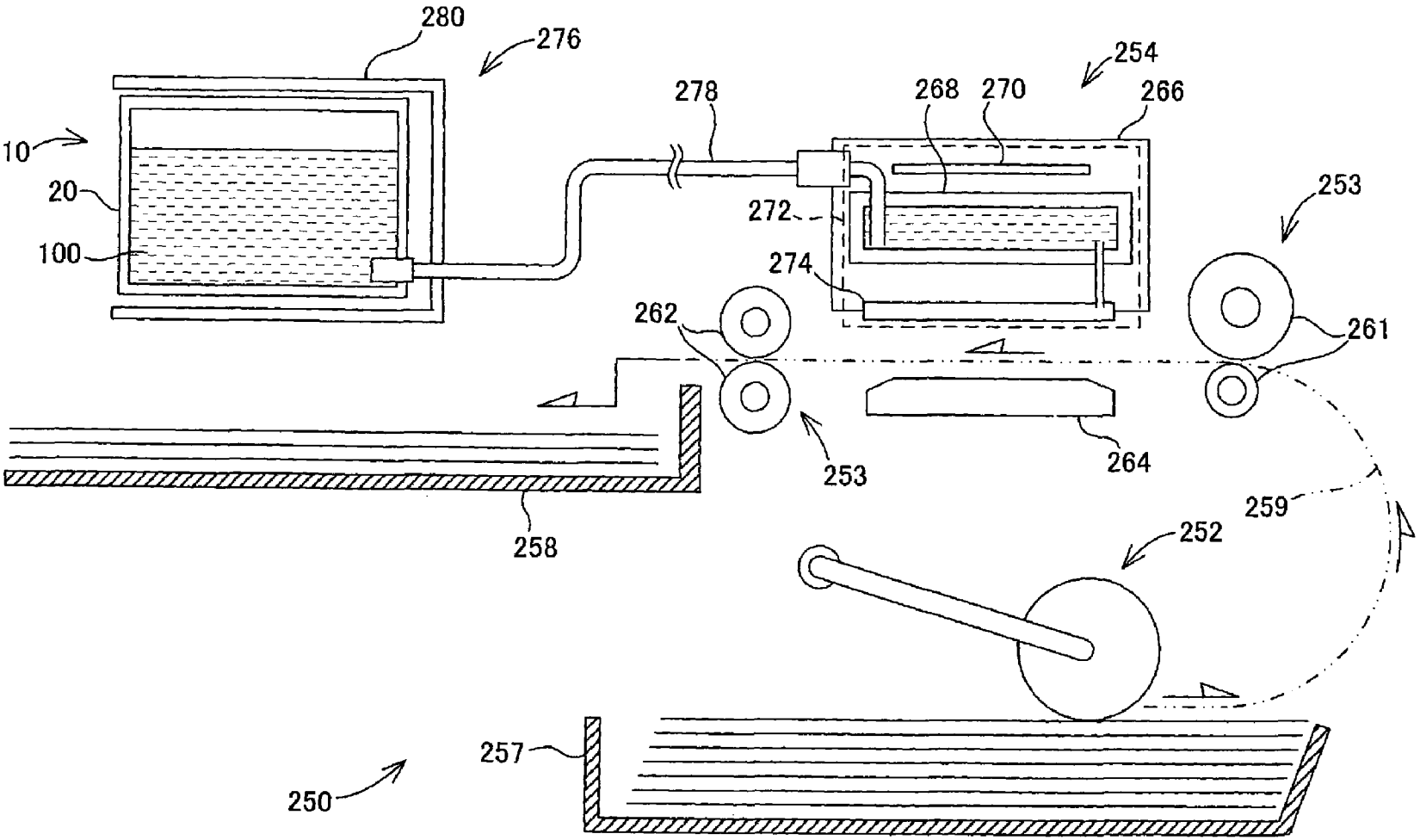
FIG. 1 is a cross-sectional, pattern diagram of a recording apparatus, according to an embodiment of the present invention.

Referring to FIG. 1, an inkjet recording apparatus 250 according to an embodiment of the invention is depicted. Recording apparatus 250 is configured to record an image, e.g., a monochrome image or color image, on a recording medium, e.g., a sheet of paper, with a plurality of, e.g., four, inks, such as a black ink, a yellow ink, a cyan ink, and a magenta ink. Recording apparatus 250 comprises a feeding device 252, a transferring device 253, a recording device 254, and a cartridge mounting portion 276. Recording apparatus 250 also comprises a first tray 257 and a second tray 258, and recording apparatus 250 has a transfer path 259 extending from first tray 257 to second tray 258. Feeding device 252 is configured to feed sheets of paper accommodated in first tray 257, one by one, to transfer path 259.

Transferring device 253 comprises a first pair of transfer rollers 261 and a second pair of transfer rollers 262 positioned along transfer path 259. First pair of transfer rollers 261 is positioned on the upstream side of recording device 254 and second pair of transfer rollers 262 is positioned on the downstream side of recording device 254 along transfer path 259.

Recording apparatus 250 also comprises a platen 264 positioned directly below recording device 254. The sheet of paper fed by feeding device 252 is transferred onto platen 264 by first pair of transfer rollers 261. Recording device 254 is configured to record an image on the sheet of paper being transferred over platen 264. A sheet of paper which passes over platen 264 is transferred by second pair of transfer rollers 262 to second tray 258, which is positioned at the downstream end of transfer path 259.

Figure 12:
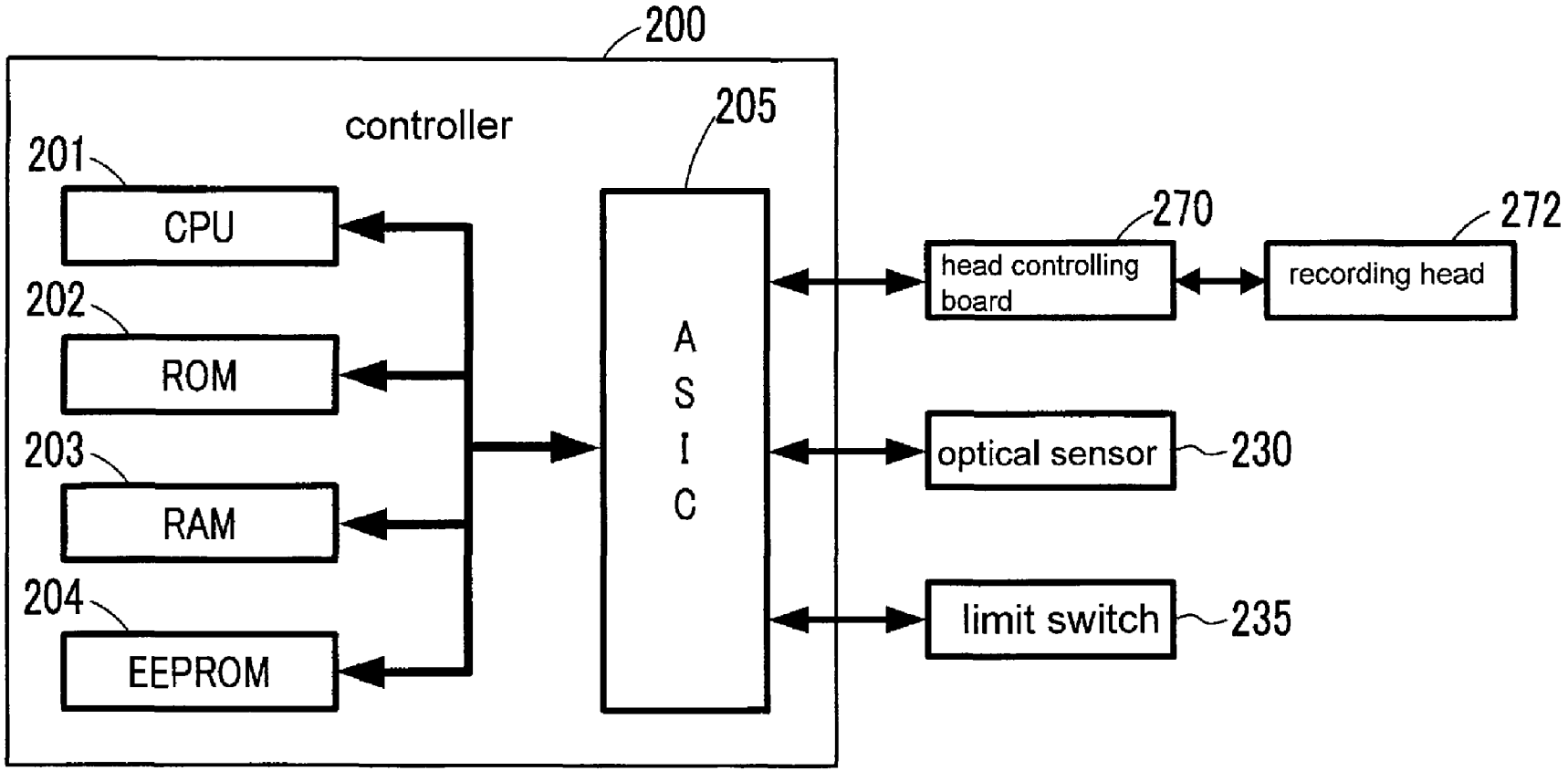
FIG. 12 is a block diagram of a controller of the recording apparatus, according to an embodiment of the present invention.

Recording device 254 comprises a carriage 266, and a recording head 272 mounted in carriage 266. Recording head 272 has a plurality of nozzles 274 formed therein, and comprises a plurality of, e.g., four, sub-tanks 268, and a head controlling board 270. Carriage 266 is supported by rails (not shown), such that carriage 266 slides on rails in a direction perpendicular to the paper plane of FIG. 1. Sub-tanks 268 each are configured to store ink to be supplied to nozzles 274. For example, each of sub-tanks 268 may store a different color ink. When a signal is inputted to head controlling board 270, head controlling board 270 controls recoding head 272 based on the inputted signal, such that ink is ejected through nozzles 274 onto the sheet of paper. Referring to FIG. 12, recording apparatus 250 comprises a controller 200 which controls the operation of recording apparatus 250. Controller 200 outputs the signal to head controlling board 270.

Referring again to FIG. 1, cartridge mounting portion 276 is configured to mount a plurality of, e.g., four, ink cartridges 10 storing a plurality of, e.g., four, kinds of inks, such as a black ink, a yellow ink, a cyan ink, and a magenta ink, respectively. Cartridge mounting portion 276 comprises a plurality of, e.g., four, cases 280 corresponding to ink cartridges 10, respectively. Ink cartridge 10 is configured to be selectively inserted into and removed from case 280. Ink cartridge 10 comprises a main body 20, and main body 20 comprises an ink chamber 100 defined therein. Ink chamber 100 is configured to store ink therein. Recording apparatus 250 comprises a plurality of, e.g., four, flexible tubes 278 connected to subtanks 268 and to cases 280, respectively. When ink cartridge 10 is mounted to cartridge mounting portion 276, ink is supplied from ink chamber 100 to a corresponding one of subtanks 268 via a corresponding one of tubes 278.

Referring to FIGS. 2-5, ink cartridge 10 has a substantially flat, hexahedron shape. A width of ink cartridge 10 in a width direction, as indicated by an arrow 31, is relatively short, and each of a height of ink cartridge 10 in a height direction, as indicated by an arrow 32, and a depth of ink cartridge 10 in a depth direction, as indicated by an arrow 33, is greater than the width of ink cartridge 10.

Ink cartridge 10 comprises an upper wall 36 and a lower wall 37, and when ink cartridge 10 is mounted to cartridge mounting portion 276, upper wall 36 is positioned above lower wall 37. Ink cartridge 10 is configured to be inserted into case 280 in an insertion direction 30, which corresponds to depth direction 33. More specifically, depth direction 33 includes a right direction and a left direction in FIGS. 3(*a*)-5, and insertion direction 30 corresponds to the left direction of depth direction 33.

Ink cartridge 10 comprises main body 20, a movable member, e.g., a housing 22, and a resilient member, e.g., a coil spring 23. Main body 20 comprises a front face 41, and a rear portion 20*b* which is a portion of main body 20 other than front face 41. Ink cartridge 10 is inserted into case 280 from the front-face 41 side. Housing 22 encloses at least a portion of rear portion 20*b* of main body 20, such that housing 22 comprises a substantial portion of outer surfaces of ink cartridge 10, and housing 22 protects rear portion 20*b* of main body 20. Each of main body 20 and housing 22 comprises a resin material, e.g., nylon, polyethylene, polypropylene, or any combination thereof.

Main body 20 and housing 22 are configured to move relative to each other, e.g., slide on each other in depth direction 33. Coil spring 23 is positioned between main body 20 and housing 22 to couple main body 20 to housing 22. For example, coil spring 23 has a first end which is coupled to main body 20 and a second end which is coupled to housing 22. Specifically, coil spring 23 is coupled to main body 20 by direct contact between the first end of coil spring 23 and main body 20, or indirect contact between the first end of coil spring 23 and main body 20, i.e., with at least one other element positioned between the first end of coil spring 23 and main body 20. Similarly, coil spring 23 is coupled to housing 22 by direct contact between the second end of coil spring 23 and housing 22, or indirect contact between the second end of coil spring 23 and housing 22, i.e., with at least one other element positioned between the second end of coil spring 23 and housing 22. Main body 20 and housing 22 move relative to each other in depth direction 33 when coil spring 23 expands and contracts.

Figure 4:
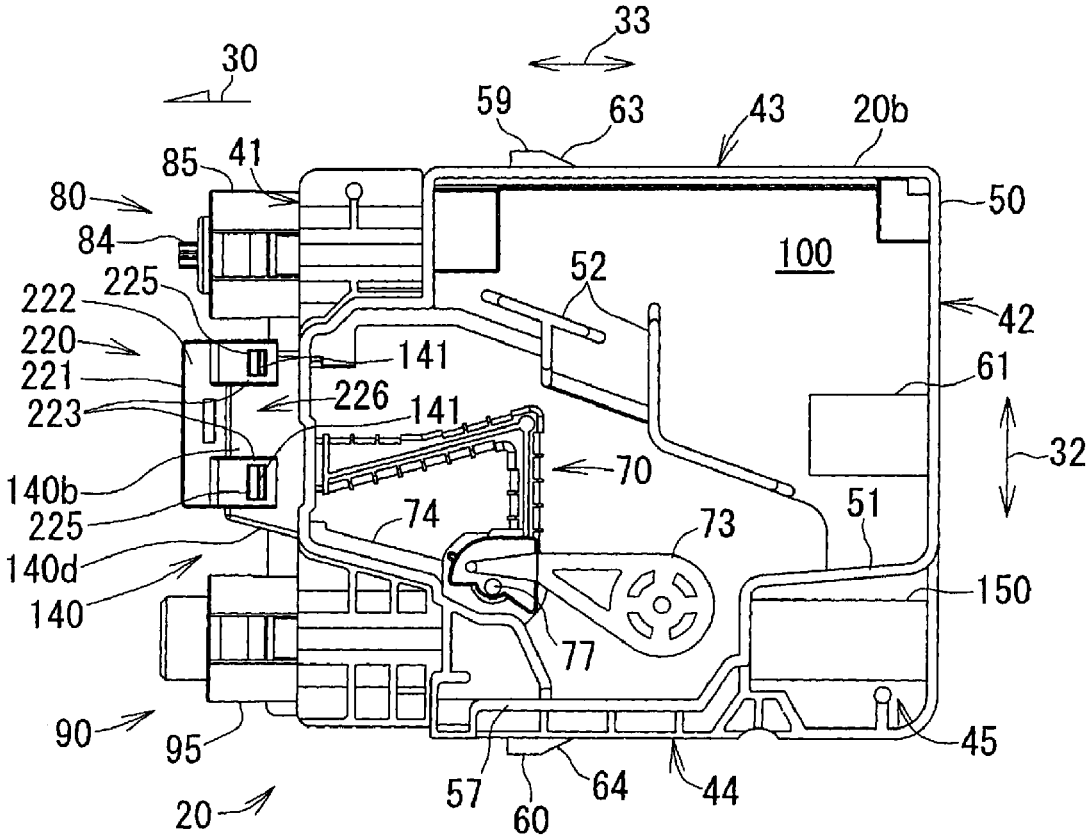
FIG. 4 is a side view of a main body, according to an embodiment of the present invention.

Referring to FIG. 4, main body 20 has a substantially, flat hexahedron shape having front face 41, a rear face 42 opposite front face 41, a top face 43, a bottom face 44 opposite top face 43, and a pair of side faces 45. Each of top face 43 and bottom face 44 is connected to front face 41 and rear face 42, and each of the pair of side faces 45 is connected to front face 41, rear face 42, top face 43, and bottom face 44. Moreover, the area of each of the pair of side faces 45 is greater than each of the area of front face 41, area of the rear face 42, area of the top face 43, and area of the bottom face 44.

Main body 20 comprises a frame 50, a pivotable member 70, an air communication valve mechanism 80, an ink supply valve mechanism 90, cover 220, and a pair of translucent films (not shown). The frame 50 defines six faces 41-45 of main body 20, such that six faces 41-45 of main body 20 correspond to six faces of the frame 50. Each of the pair of translucent films is connected to, e.g., attached to, a corresponding one of the pair of side faces 45 of frame 50 such that ink chamber 100 is defined by frame 50 and the pair of films.

Frame 50 comprises a translucent resin material, e.g., a transparent material or a semi-transparent material, and light may pass therethrough. In this embodiment, frame 50 is manufactured by injection-molding polypropylene. Alternatively, frame 50 may be manufactured by injection-molding polyacetal, nylon, polyethylene, or the like.

Frame 50 comprises an outer peripheral wall 51 and a plurality of inner walls or inner ribs 52. Inner walls or inner ribs 52 are positioned inside outer peripheral wall 51. Outer peripheral wall 51 and inner walls or inner ribs 52 are integral and define frame 50. Outer peripheral wall 51 and inner walls or inner ribs 52 extend from one of side faces 45 to the other of side faces 45 of frame 50. Outer peripheral wall 51 has a substantially square or rectangular perimeter extending along front face 41, top face 43, rear face 42, and bottom surface 44 defining a space in the interior thereof. Accordingly, openings 57 are formed on side faces 45, respectively, of frame 50, such that side faces 45 of frame 50 are opened.

Each of the pair of films is connected to, e.g., adhered to, a corresponding one of side faces 45 of frame 50 via an adhesion method, e.g., a thermal adhesion method. More specifically, each of the pair of films is adhered to a corresponding one end of outer peripheral wall 51 in width direction 31. Openings 57 are closed by the pair of films, respectively, and a space surrounded by outer peripheral wall 51 and the pair of films comprises ink chamber 100. Alternatively, a container-shaped frame which is opened on one of the side faces 45 may be used instead of frame 50. In this case, ink chamber 100 is defined by the film adhered to the one of side faces 45 of the container-shaped frame.

Each of the pair of films also is adhered to inner walls or inner ribs 52 at a corresponding one end thereof in width direction 31. Consequently, inner walls or inner ribs 52 restrict the ability of the pair of films, and/or housing 22 to move inward, such that inner walls or inner ribs 52 limit an amount of deformation of the pair of films and/or housing 22.

Frame 50 has an ink introduction hole 150 formed therein, and ink introduction hole 150 has a cylindrical shape and extends from rear face 42 toward ink chamber 100. Ink introduction hole 150 is configured to be fluid communication with ink chamber 100, and ink is introduced to ink chamber 100 via ink introduction hole 150 when ink cartridge 10 is manufactured.

Frame 50 has a spring receiving chamber 61 formed therein, and spring receiving chamber 61 has a cylindrical shape and extends from rear face 42 toward ink chamber 100. Spring receiving chamber 61 may not be in fluid communication with ink chamber 100. When ink cartridge 10 is mounted in cartridge mounting portion 276, spring receiving chamber 61 is positioned above ink introduction hole 150 and positioned at a middle portion of rear face 42 in height direction 32. Spring receiving chamber 61 is configured to receive the first end of coil spring 23.

Figure 3A:
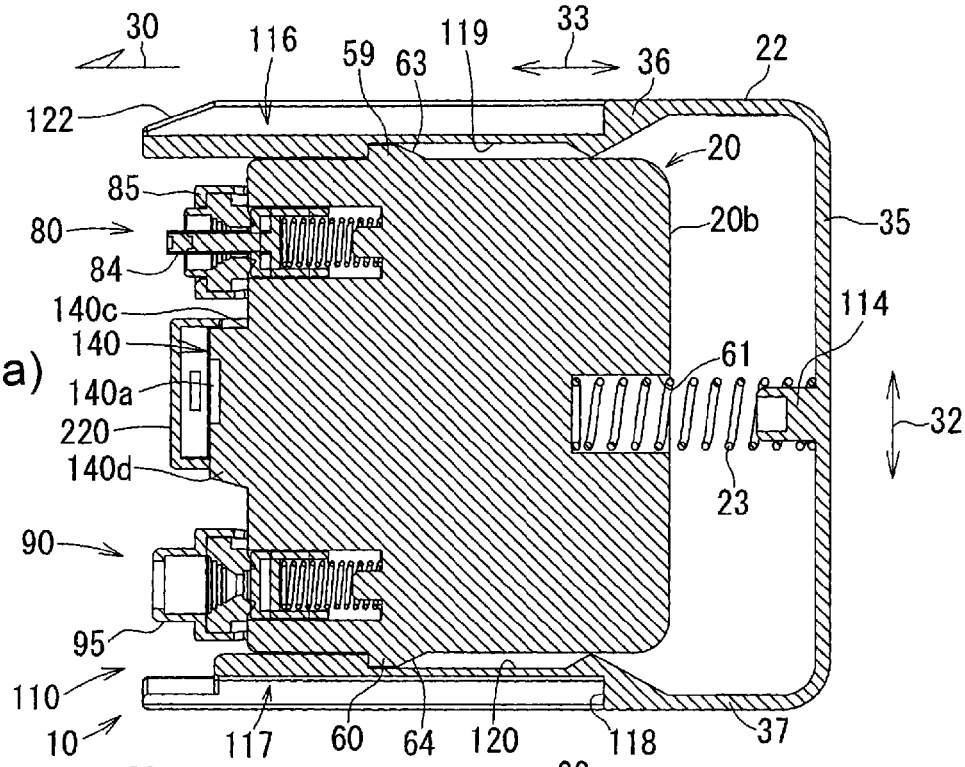
FIGS. 3(*a*) and 3(*b*) are cross-sectional views taken along the line III-III of FIG. 2, in which a coil spring has expanded and contracted, respectively.
Figure 3B:
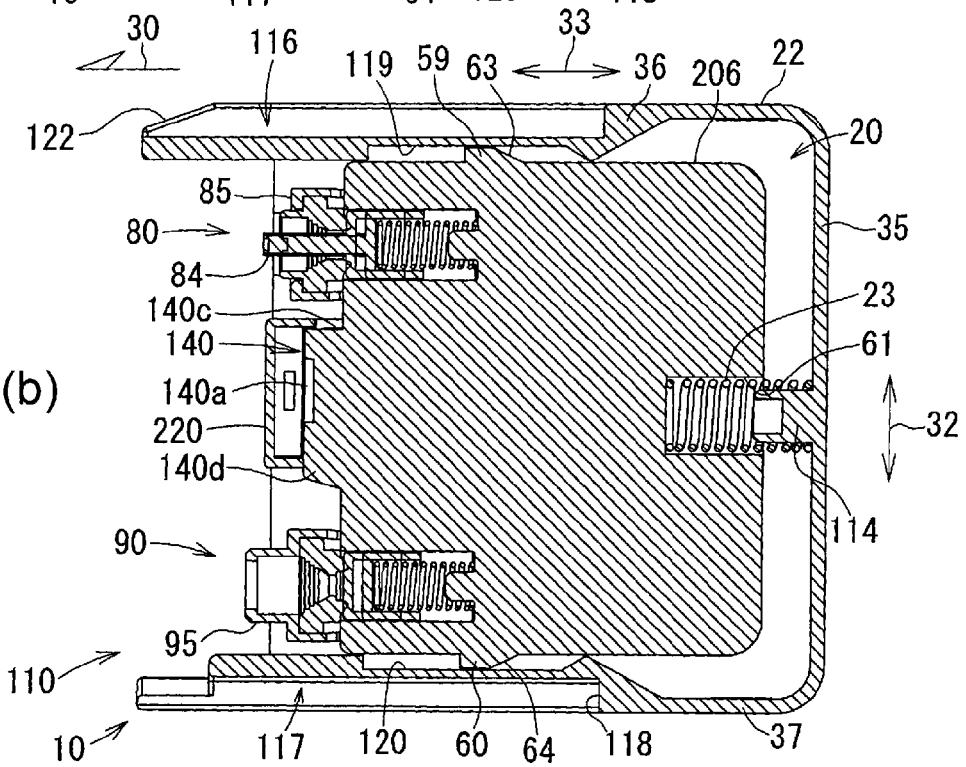

Frame 50 comprises a protrusion 59 positioned at top face 43, and a protrusion 60 positioned at bottom face 44. Protrusion 59 extends outward from top face 43 in a direction perpendicular to top face 43, and protrusion 60 extends outward from bottom face 44 in a direction perpendicular to bottom face 44. Protrusion 59 is positioned frontward from a middle portion of top face 43 in depth direction 33, and protrusion 60 is positioned frontward from a middle portion of bottom face 44 in depth direction 33. Protrusion 59 and protrusion 60 are integral with frame 50. Referring to FIG. 3, when main body 20 is inserted into housing 22, protrusion 59 is inserted into a guide groove 119 formed in housing 22, and protrusion 60 is inserted into a guide groove 120 formed in housing 22.

Protrusion 59 comprises an inclined surface 63 on the rear-face 42 side of protrusion 59, and protrusion 60 comprises an inclined surface 64 on the rear-face 42 side of protrusion 60. When main body 20 is inserted into housing 22, each of inclined surface 63 and inclined surface 64 of protrusion 59 and protrusion 60, respectively, contacts an edge of an opening 110 of housing 22, which causes main body 20 to go into housing 22 smoothly. Until protrusion 59 and protrusion 60 go into guide groove 119 and guide groove 120, respectively, upper wall 36 and lower wall 37 of housing 22 are elastically bend outward by protrusion 59 and protrusion 60, respectively. When protrusion 59 and protrusion 60 go into guide groove 119 and guide groove 120, respectively, upper wall 36 and lower wall 37 of housing 22 are restored into their original shapes, respectively. Once protrusion 59 and protrusion 60 go into guide groove 119 and guide groove 120, respectively, it is difficult to remove main body 20 from housing 22 because protrusion 59 and protrusion 60 contact ends of guide groove 119 and guide groove 120, respectively.

Referring to FIGS. 2-5, frame 50 comprises a translucent portion 140 which is positioned at front face 41 and extends away from ink chamber 100. An amount of ink stored in ink chamber 100 is optically or visually detected via translucent portion 140. Translucent portion 140 is integral with frame 50, and comprises the same material as frame 50, e.g., translucent portion 140 may comprise a translucent resin material which allows light to pass therethrough.

Translucent portion 140 projects outward from a middle portion of front face 41 of frame 50 in height direction 32. Translucent portion 140 comprises five rectangular walls and has a substantially a hollow box shape. For example, translucent portion 140 comprises a front wall 140*a*, a pair of side walls 140*b*, a top wall 140*c*, and a bottom wall 140*d*. Front wall 140*a* extends parallel to front face 41 and is separated from front face 41 by a predetermined distance. Side walls 140*b* are connected to front face 41 and front wall 140*a*, top wall 140*c* is connected to top ends of front wall 140*a* and side walls 140*b*, and bottom wall 140*d* is connected to bottom ends of front wall 140*a* and side walls 140*b*. Moreover, the width of front wall 140*a* is less than the width of front face 41. Translucent portion 140 is configured to receive light, e.g., visible or infrared light, emitted from an optical sensor 230, e.g., a photo interrupter, positioned in recording apparatus 250. When ink cartridge 10 is mounted to recording apparatus 250, a light emitting element of optical sensor 230 faces one of side walls 140*b* and a light receiving element of optical sensor 230 faces the other of the side walls 140*b*. Light emitted from the light emitting element of optical sensor 230 may pass through side walls 140*b* and reach the light receiving element of optical sensor 230.

Two claws 141 are positioned at each of side walls 140*b*, and are aligned in height direction 32. Claws 141 are used for attaching a cover 220 to translucent portion 140.

Cover 220 is attached to translucent portion 140. Cover 220 comprises an opaque material, such that when cover 220 receives light emitted from the light emitting element of optical sensor 230, cover 220 blocks the light, e.g., the light is prevented from passing through cover 220, and/or the path of the light is altered. Cover 220 comprises a rectangular base portion 221 facing and covering front wall 140*a*, a rectangular cylindrical side wall 222 extending from four sides of rectangular base portion 221 toward front face 41, and four leg portions 223 extending from side wall 222 toward front face 41. Two of leg portions 223 cover portions of one of side walls 140*b* and are aligned in height direction 32 at positions corresponding to two claws 141. The other two leg portions 223 cover portions of the other of side walls 140*b* and are aligned in height direction 32 at positions corresponding to the other two claws 141. Each of leg portions 223 has an opening 225 formed therethrough. Four claws 141 are positioned in openings 225 of four leg portions 223, respectively, such that cover 220 is attached to translucent portion 140. An opening 226 is formed between two leg portions 223 aligned in height direction 32 at each of side walls 140*b*. Opening 226 exposes a portion of a corresponding one of side walls 140*b*, such that the exposed portion of side wall 140*b* receives light emitted from the light emitting element of optical sensor 230.

During insertion of ink cartridge 10 into case 280, a portion of cover 220 blocks light emitted from the light emitting element of optical sensor 230.

Figure 5:
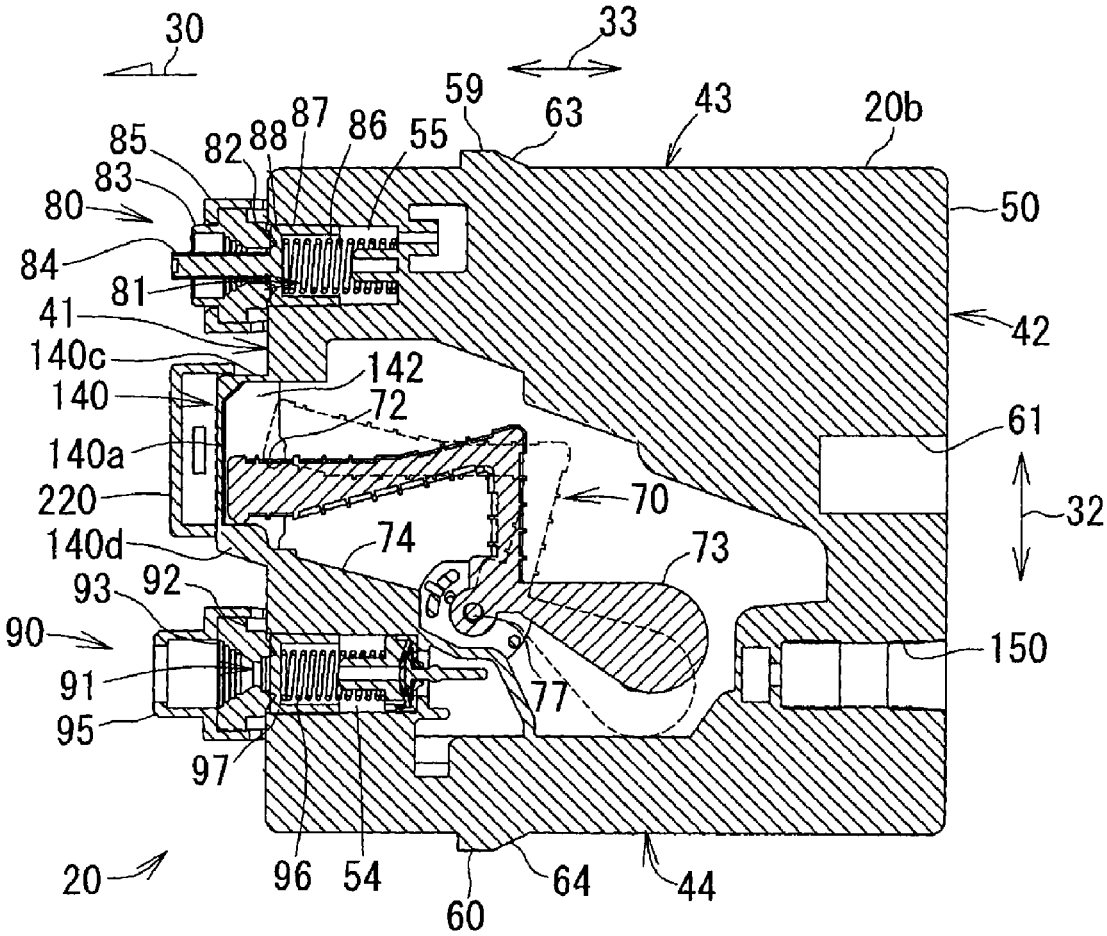
FIG. 5 is cross-sectional view of the main body of FIG. 4.

Translucent portion 140 has an inner space 142 defined by front wall 140*a*, side walls 140*b*, top wall 140*c*, and bottom wall 140*d*. There may be no wall between inner space 142 and ink chamber 100, such that inner space 142 is in fluid communication with ink chamber 100. Pivotable member 70 comprises an indication portion 72, and indication portion 72 is configured to selectively move into and out of inner space 142 based on an amount of ink within ink chamber 100. In FIG. 5, pivotable member 70 whose indication portion 72 is positioned in inner space 142 is depicted in a solid line, and pivotable member 70 whose indication portion 72 is positioned outside of inner space 142 is depicted in a broken line.

Pivotable member 70 is configured to pivot based on the amount of ink within ink chamber 100. Pivotable member 70 comprises indication portion 72 positioned at a first end of pivotable member 70, and a float portion 73 positioned at a second end of pivotable member 70 opposite the first end of pivotable member 70. Frame 50 comprises a support wall 74 extending into ink chamber 100 from a center portion of outer peripheral wall 51 in width direction 31. Support wall 74 is positioned adjacent to a corner between front face 41 and bottom face 44, and comprises a support shaft 77 extending in width direction 31. Pivotable member 70 is supported by support shaft 77, such that pivotable member 70 pivots about support shaft 77. Float portion 73 has a hollow formed therein, and the specific gravity of float portion 73 is less than the specific gravity of ink within ink chamber 100, such that float portion 73 floats on ink. Float portion 73 selectively moves up and down based on whether the amount of ink within ink chamber 100 increases or decreases, respectively, and pivotable member 70 pivots based on the movement of float portion 73.

When ink chamber 100 has a sufficient amount of ink therein, pivotable member 70 is positioned, such that indication portion 72 is positioned in inner space 142. When ink chamber 100 does not have a sufficient amount of ink therein, e.g., ink chamber 100 is empty or is substantially empty, pivotable member 70 is positioned, such that indication portion 72 is positioned outside of inner space 142. By monitoring whether indication portion 72 is in inner space 142, e.g., using optical sensor 230, it may be determined whether ink chamber 100 has a sufficient amount of ink therein.

Front face 41 of frame 50 has a circular opening 82 formed therethrough, and opening 82 is positioned above translucent portion 140 when ink cartridge 10 is mounted to cartridge mounting portion 276. Frame 50 has a cylindrical valve accommodating chamber 55 formed therein, and valve accommodating chamber 55 extends from opening 82 toward ink chamber 100 in depth direction 33. Valve accommodating chamber 55 is in fluid communication with ink chamber 100 at an end of valve accommodating chamber 55 opposite opening 82. Air communication valve mechanism 80 is accommodated in valve accommodating chamber 55.

Air communication valve mechanism 80 is configured to selectively open and block a path extending from the outside of frame 50 to ink chamber 100 via opening 82. Air communication valve mechanism 80 comprises a valve body 87, a spring 86, a sealing member 83, and a cap 85. Valve body 87 is configured to slide in valve accommodating chamber 55 in depth direction 33. Valve body 87 comprises a lid 88 and a rod 84 extending from lid 88 to the outside of frame 50 through opening 82 and an air communication opening 81. The diameter of rod 84 is less than the diameter of air communication opening 81, such that there is a gap between the edge of air communication opening 81 and rod 84. Lid 88 has a circular shape, and rod 84 extends from the center of lid 88 through the center of opening 82.

Valve body 87 is configured to slide in valve accommodating chamber 55 between a close position in which lid 88 contacts sealing member 83 and an open position in which lid 88 is separated from sealing member 83. When lid 88 contacts sealing member 83, air communication opening 81 is covered by lid 88, which causes a path extending from valve accommodating chamber 55 to the outside of frame 50 via the gap between the edge of air communication opening 81 and rod 84 to be blocked, such that the path extending from the outside of frame 50 to ink chamber 100 via opening 82 is blocked. When lid 88 is separated from sealing member 83, air communication opening 81 is uncovered, which causes a path extending from valve accommodating chamber 55 to the outside of frame 50 via the gap between the edge of air communication opening 81 and rod 84 to be opened, such that the path extending from the outside of frame 50 to ink chamber 100 via opening 82 is opened.

Cap 85 is attached to frame 50 at the area surrounding opening 82 sandwiching sealing member 83 therebetween. Each of cap 85 and sealing member 83 has an opening formed therethrough, and the opening extends in depth direction 33. The openings of cap 85 and sealing member 83 form air communication opening 81.

Spring 86 is configured to urge valve body 87 toward sealing member 83, such that lid 88 contacts sealing member 83. Air communication valve mechanism 80 covers air communication opening 81 with lid 88 accordingly. When rod 84 receives an external force toward valve accommodating chamber 55 in depth direction 33, lid 88 of valve body 87 moves to separate from sealing member 83 against the urging force of spring 86, and therefore, air communication opening 81 is uncovered. This causes the path extending from the outside of frame 50 to ink chamber 100 via opening 82 to be opened. The pressure within ink chamber 100 thus becomes equal to the atmospheric pressure.

Front face 41 of frame 50 has a circular opening 92 formed therethrough, and opening 92 is positioned below translucent portion 140 when ink cartridge 10 is mounted to cartridge mounting portion 276. Frame 50 has a cylindrical valve accommodating chamber 54 formed therein, and valve accommodating chamber 54 extends from opening 92 toward ink chamber 100 in depth direction 33. Valve accommodating chamber 54 is in fluid communication with ink chamber 100 at an end of valve accommodating chamber 54 opposite opening 92. Ink supply valve mechanism 90 is accommodated in valve accommodating chamber 54.

Ink supply valve mechanism 90 is configured to selectively open and block a path extending from the outside of frame 50 to ink chamber 100 via opening 92. Ink supply valve mechanism 90 comprises a valve body 97, a spring 96, a sealing member 93, and a cap 95.

Figure 8:
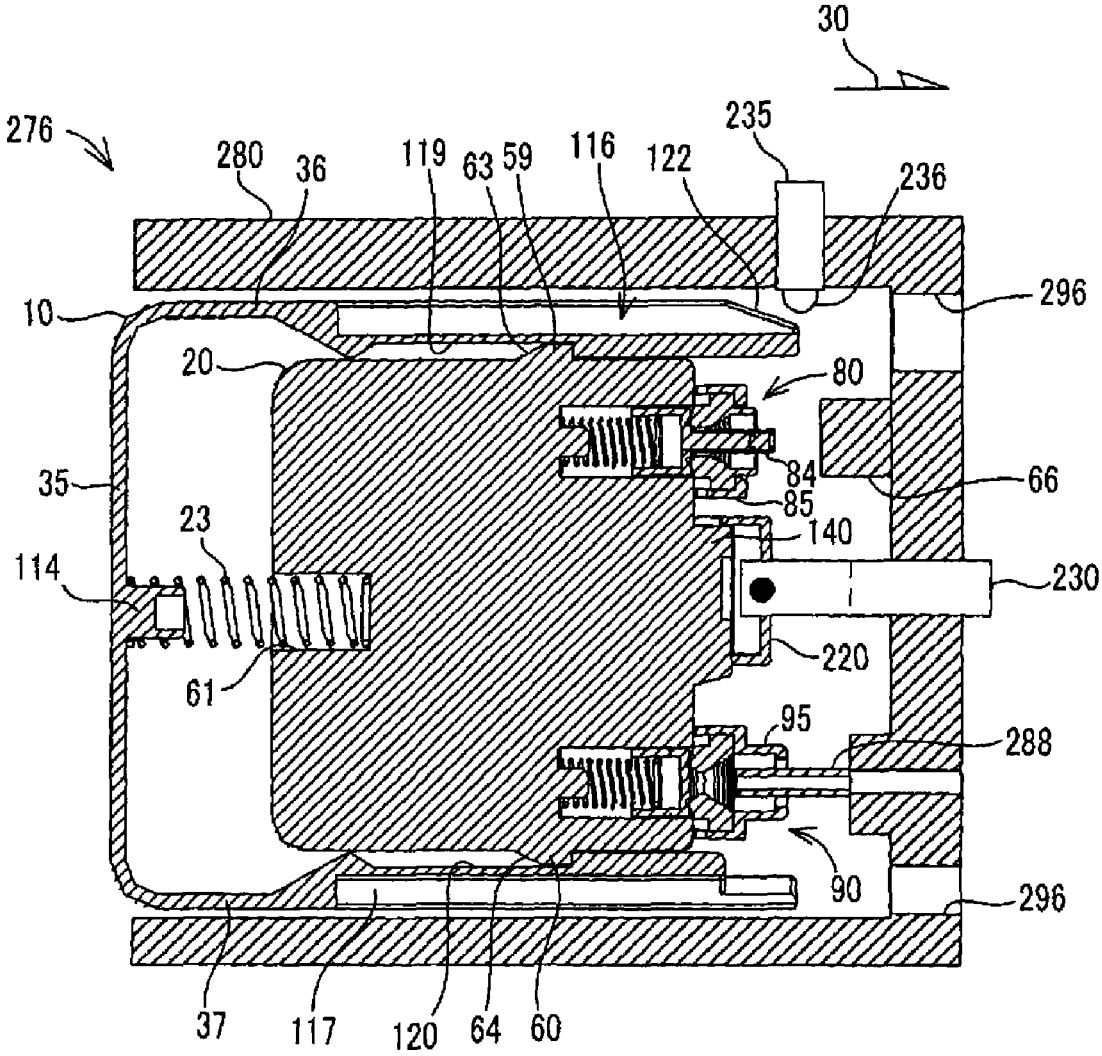
FIG. 8 is a cross-sectional, pattern diagram of ink cartridge of FIG. 2 and a cartridge mounting portion of FIG. 6, in which a cover of the ink cartridge is positioned in a optical path of an optical sensor.
Figure 9:
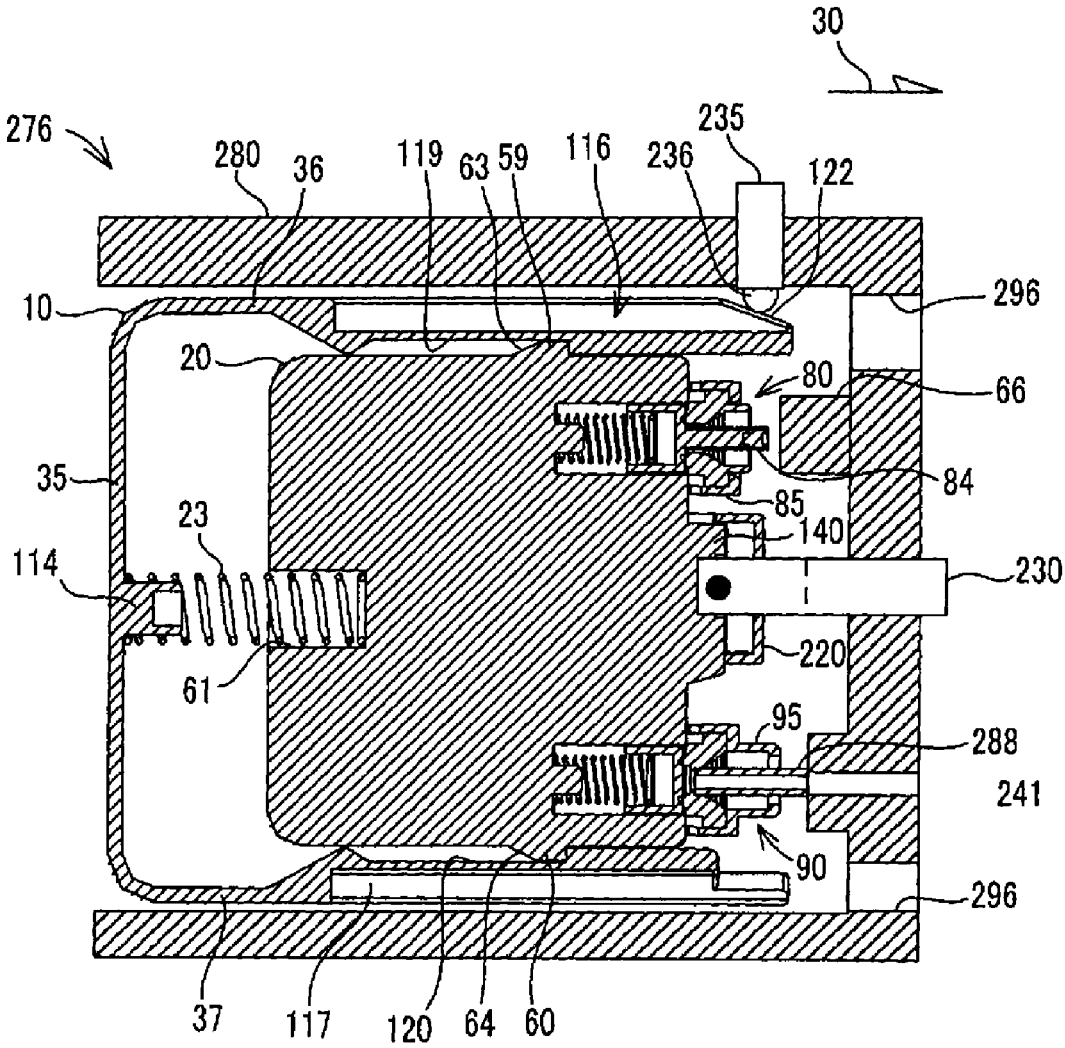
FIG. 9 is a cross-sectional, pattern diagram of ink cartridge of FIG. 2 and a cartridge mounting portion of FIG. 6, in which a inclined surface of the ink cartridge is positioned under a limit switch.
Figure 10:
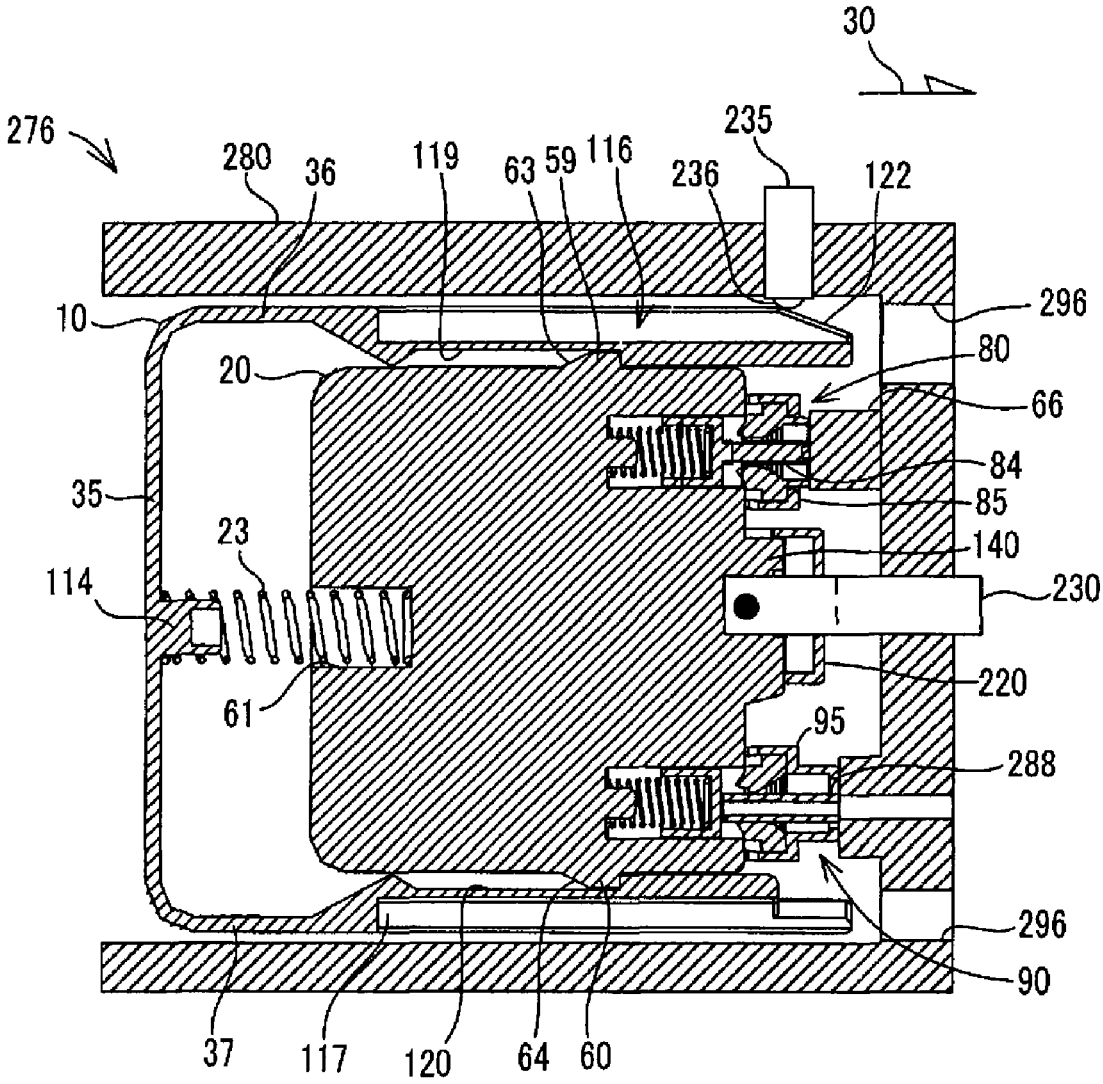
FIG. 10 is a cross-sectional, pattern diagram of ink cartridge of FIG. 2 and a cartridge mounting portion of FIG. 6, in which the ink cartridge contacts a closed end of a case of the cartridge mounting portion.
Figure 11:
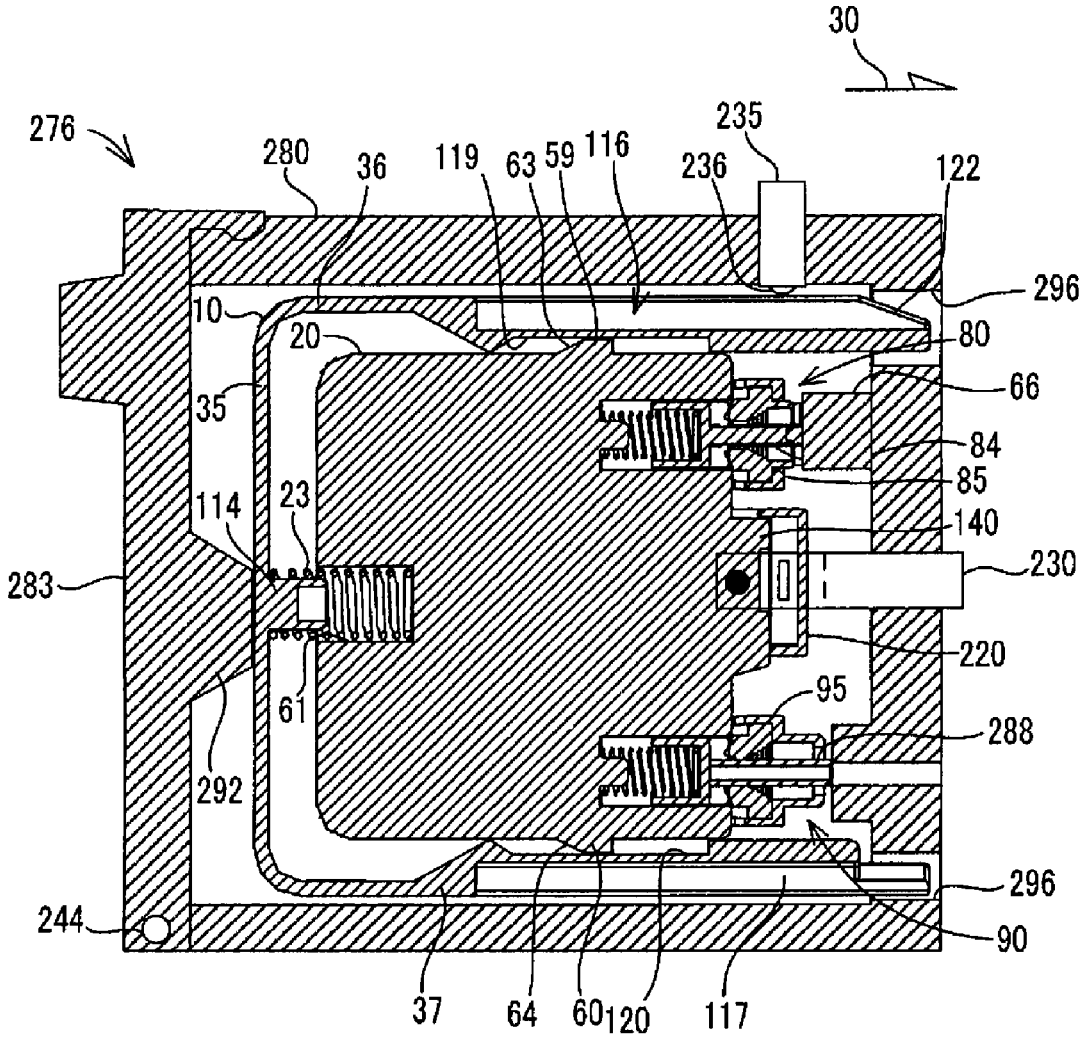
FIG. 11 is a cross-sectional, pattern diagram of ink cartridge of FIG. 2 and a cartridge mounting portion of FIG. 6, in which a lock lever is locked to the case of the cartridge mounting portion.

Cap 95 is attached to frame 50 at the area surrounding opening 92 sandwiching sealing member 93 therebetween. Each of cap 95 and sealing member 93 has an opening formed therethrough, and the opening extends in depth direction 33. The openings of cap 95 and sealing member 93 form an ink supply opening 91, and valve accommodating chamber 54 is configured to be in fluid communication with the outside of frame 50 via ink supply opening 91. Referring to FIGS. 8-10, when ink cartridge 10 is mounted to cartridge mounting portion 276, a cylindrical push rod 288 enters ink supply opening 91.

Referring again to FIGS. 2-5, spring 96 is configured to urge valve body 97 toward sealing member 93, such that valve body 97 contacts sealing member 93. Ink supply valve mechanism 90 covers ink supply opening 91 with valve body 97 accordingly. When push rod 288 enters ink supply opening 91 and applies a force to valve body 97 toward ink chamber 100 in depth direction 33, valve body 97 moves to separate from sealing member 93 against the urging force of spring 96 and therefore ink supply opening 91 is uncovered. This enables ink within ink chamber 100 to be supplied to recording head 272 via push rod 288.

Figure 2:
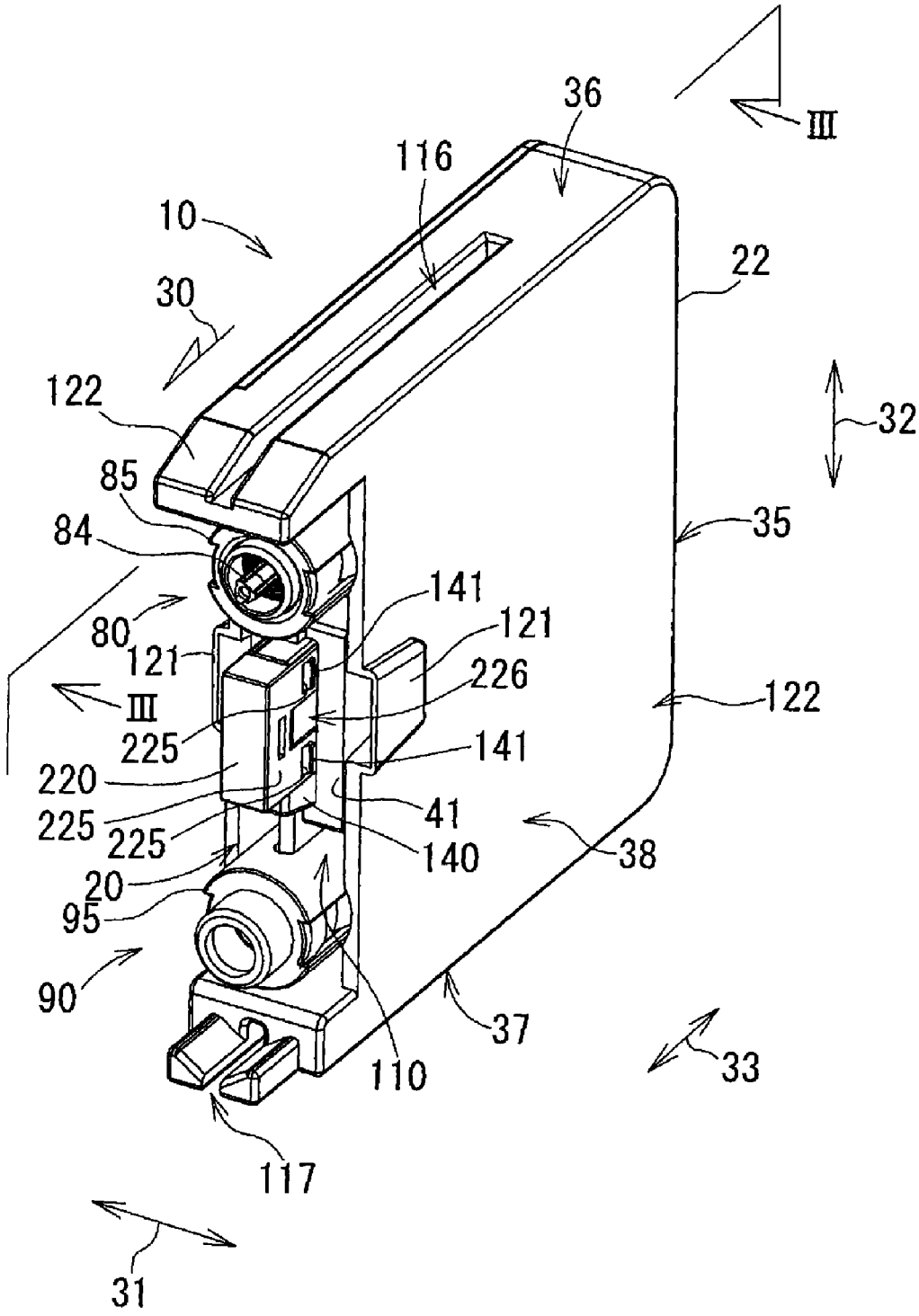
FIG. 2 is a perspective view of an ink cartridge, according to an embodiment of the present invention.

Referring to FIGS. 2 and 3, housing 22 has a substantially flat hexahedron container shape, and encloses at least a portion of rear portion 20*b* of main body 20. Housing 22 comprises a rear wall 35 covering rear face 42 of main body 20, upper wall 36 covering at least a portion of top face 43 of main body 20, lower wall 37 covering at least a portion of bottom face 44 of main body 20, and a pair of side walls 38 covering at least a portion of the pair of side faces 45 of main body 20, and a space surrounded by rear wall 35, upper wall 36, lower wall 37, and side walls 38 accommodates rear portion 20*b* of main body 20.

Housing 22 has opening 110 defined by upper wall 36, lower wall 37, and side walls 38. When ink cartridge 10 is assembled, main body 20 is inserted into housing 22 from opening 110.

Each of side walls 38 has a pocket 121 formed therein, and pocket 121 extends from opening 110 toward rear wall 35. When ink cartridge 10 is mounted to cartridge mounting portion 276, pockets 121 accommodate portions of optical sensor 230. Pockets 121 are positioned symmetrically with respect to a plane which is parallel to height direction 32 and depth direction 33. One of pockets 121 is configured to accommodate at least a portion of the light emitting element of optical sensor 230, and the other one of pockets 121 is configured to accommodate at least a portion of the light receiving element of optical sensor 230. In another embodiment, pockets 121 may be omitted, and instead, side walls 38 may be cut out at portions corresponding to pockets 121.

Guide groove 119 is formed in the inner surface of upper wall 36, and guide groove 120 is formed in the inner surface of lower wall 37. Each of guide grooves 119 and 120 extends in depth direction 33. Protrusions 59 and 60 are inserted into guide grooves 119 and 120, respectively. Main body 20 slides on housing 22 in depth direction 33 accordingly.

Housing 22 comprises a cylindrical spring seat 114 positioned at the inner surface of rear wall 35. Spring seat 114 extends from the inner surface of rear wall 35 toward spring receiving chamber 61 in depth direction 33. Spring seat 114 fits into loops of coil spring 23, such that the second end of coil spring 23 is supported by spring seat 114.

Figure 7:
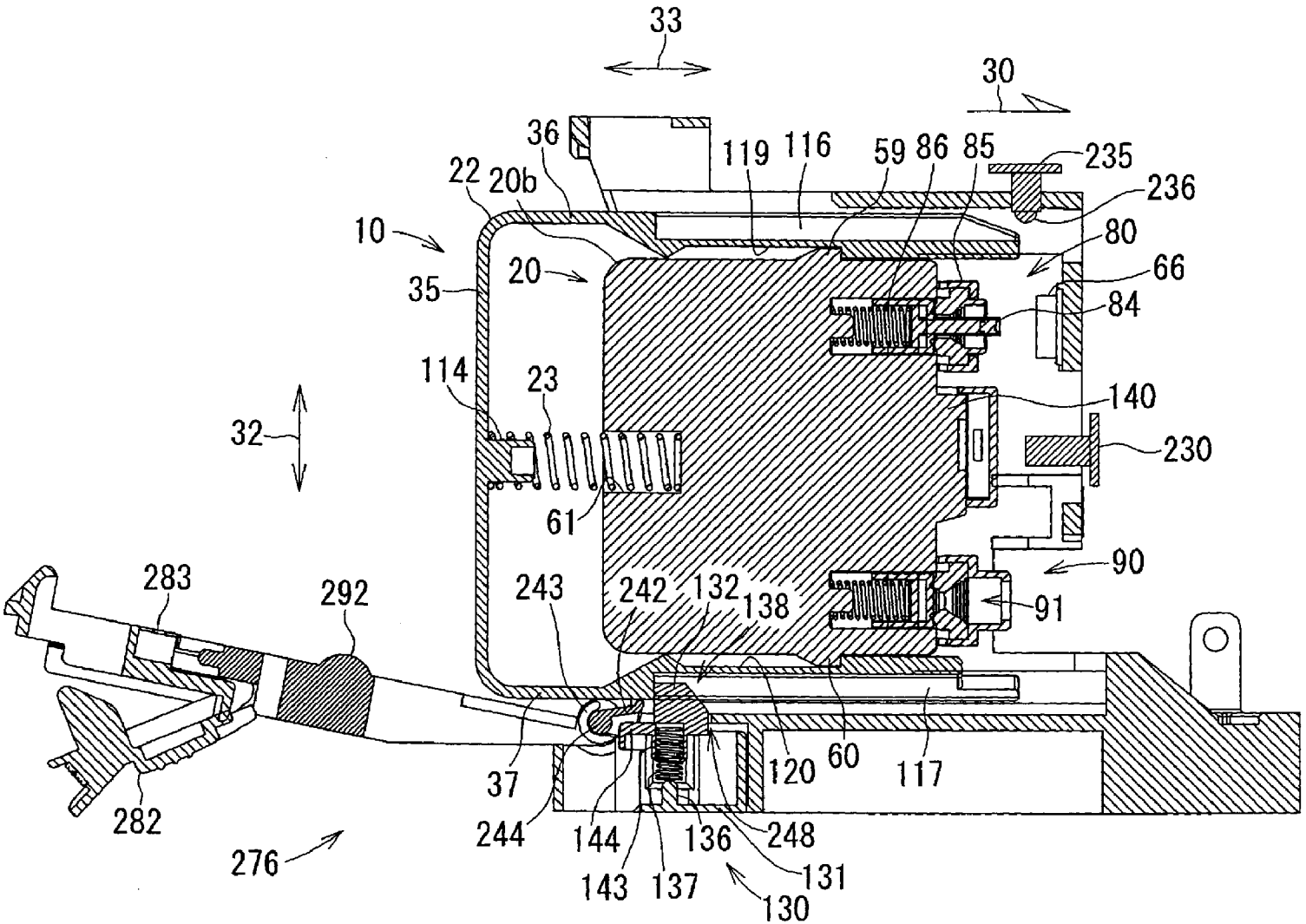
FIG. 7 is a cross-sectional view taken along the line VII-VII of FIG. 6.

A guide groove 116 is formed in the outer surface of upper wall 36, and a guide groove 117 is formed in the outer surface of lower wall 37. Guide grooves 116 and 117 each extend in depth direction 33 and have the same or substantially the same length in depth direction 33. The length of guide grooves 116 and 117 is greater than the length of guide grooves 119 and 120 in depth direction 33. Guide groove 116 extends to the front end of upper wall 36 and is opened to the outside at the front end of upper wall 36, and guide groove 117 extends to the front end of lower wall 37 and is opened to the outside at the front end of lower wall 37. Referring to FIG. 7, when ink cartridge 10 is inserted into case 280, a rail (not shown) positioned at an upper portion of case 280 enters guide groove 116, and a protrusion 132 protruding from a lower portion of case 280 enters guide groove 117. Ink cartridge 10 is inserted into case 280 in insertion direction 30 smoothly, guided by guide grooves 116 and 117, the rail, and protrusion 132.

Referring to FIG. 3, guide groove 117 extends from the front end of lower wall 37 toward rear wall 35 in depth direction 33, and an end of guide groove 117 opposite the front end of lower wall 37 is bounded by a wall 118. During the insertion of ink cartridge 10 into case 280, protrusion 132 contacts wall 118, such that further insertion of ink cartridge 10 is prevented.

Housing 22 comprises an inclined surface 122 positioned at the front end of upper wall 36. Inclined surface 112 is inclined with respect to depth direction 33, and when ink cartridge 10 is inserted into case 280, inclined surface 122 is inclined with respect to insertion direction 30. Referring to FIGS. 7-10, during the insertion of ink cartridge 10 into case 280, inclined surface 122 pushes an actuator 236 of a limit switch 235 positioned in case 280, such that contacts of limit switch 235 are electrically connected. When ink cartridge 10 which is not defective is inserted into case 280, cover 220 first blocks the light of optical sensor 230, and subsequently inclined surface 122 pushes the actuator 236.

When ink cartridge 10 is assembled, the second end of coil spring 23 is attached to spring seat 114. Subsequently, rear portion 20*b* of main body 20 is inserted into housing 22 via opening 110 while the depth of main body 20 is aligned with the depth of housing 22. When this occurs, the first end of coil spring 23 is inserted into spring receiving chamber 61. When rear portion 20*b* of main body 20 is further inserted into housing 22 against the urging force of coil spring 23, protrusions 59 and 60 are inserted into guide grooves 119 and 120, which complete the assembly. Coil spring 23 urges main body 20 toward opening 110 in depth direction 33, and main body 20 slides on housing 22 in depth direction 33.

When ink cartridge 10 contacts a surface, e.g., when a user drops ink cartridge 10, the impact of the contact may cause main body 20 to bite into housing 22. When this occurs, main body 20 no longer may be able to slide on housing 22. When coil spring 23 inadvertently is omitted during the assembly of ink cartridge 10, or when a defective coil spring 23 is loaded to ink cartridge 10 during assembly of ink cartridge 10, ink cartridge 10 may not be mounted to cartridge mounting portion 276 completely, which may cause ink leakage between ink cartridge 10 and cartridge mounting portion 276 or may cause image recording failure. Controller 200 determines whether ink cartridge 10 has at least one predetermined characteristic associated therewith when ink cartridge 10 is mounted to cartridge mounting portion 276. For example, the at least one characteristic may correspond to a defect associated with ink cartridge 10, such that if ink cartridge 10 includes the defect, it may be undesirable to use ink cartridge 10 with recording apparatus 250, e.g., the defective ink cartridge 10 may not be an appropriate ink cartridge to use with recording apparatus 250.

Figure 6:
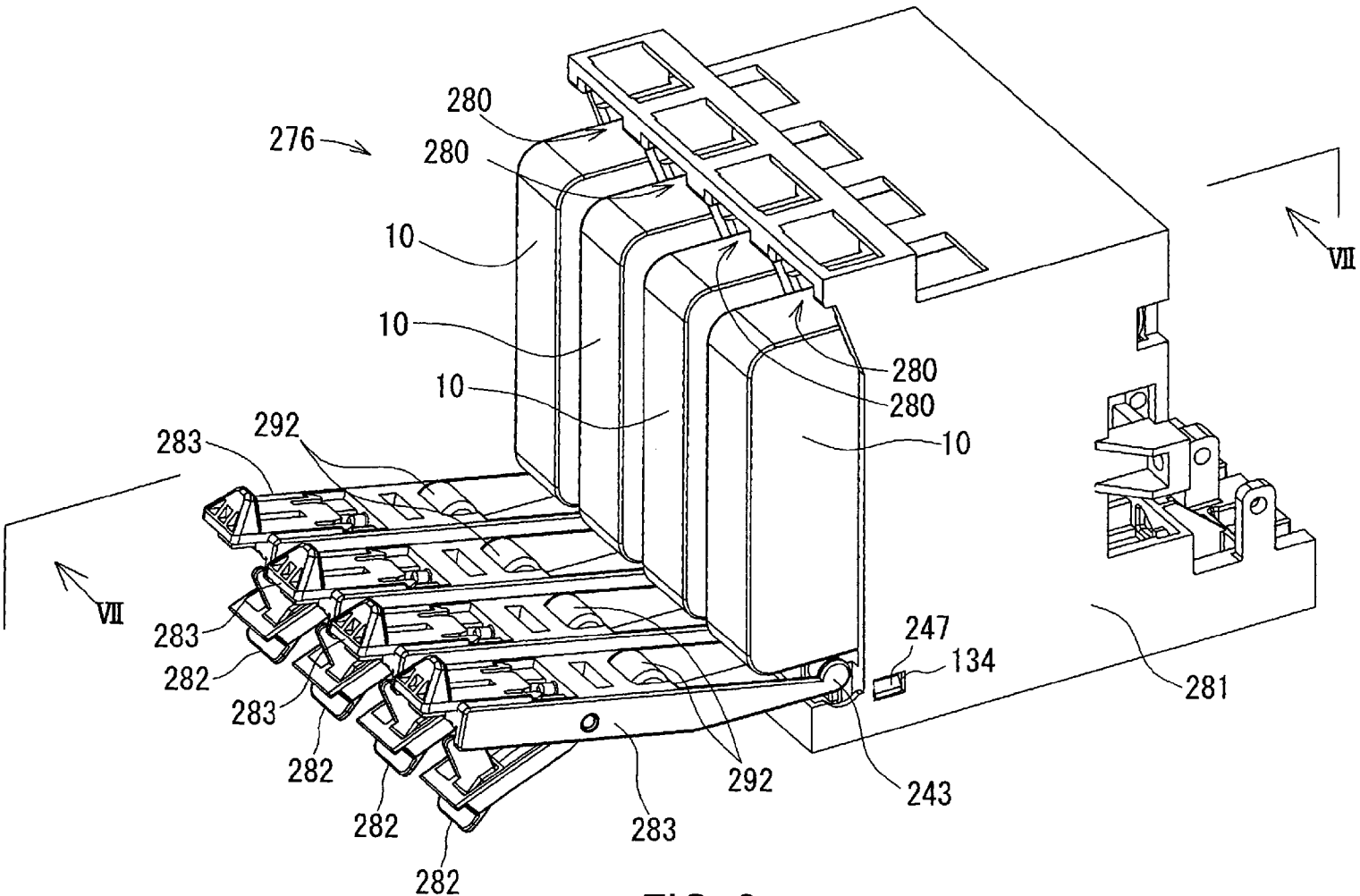
FIG. 6 is a perspective view of a cartridge mounting portion, in which ink cartridges of FIG. 2 are mounted, according to an embodiment of the present invention.

Referring to FIGS. 6 and 7, cartridge mounting portion 276 comprises a case main body 281, and case main body 281 may comprise four cases 280. Four cases 280 are configured to mount four ink cartridges 10, respectively. Each ink cartridge 10 is assigned to one of four cases 280, e.g., based on the color of ink which ink cartridge 10 stores. For example, ink cartridge 10 storing black ink is inserted into the leftmost case 280, ink cartridge 10 storing yellow ink is inserted into the rightmost case 280, the ink cartridge 10 storing magenta ink is inserted into case 280 which is immediately neighboring the leftmost case 280, and ink cartridge 10 storing cyan ink is inserted into case 280 which is immediately neighboring the rightmost case 280.

Case 280 has an open end from which ink cartridge 10 is inserted, and a closed end opposite the open end. A lock lever 283 is positioned at the open end of each case 280. Lock lever 283 is configured to be selectively opened and closed to selectively cover and uncover the open end of case 280.

A shaft 244 is positioned at the lower edge of the open end of case 280. Lock lever 283 comprises a pair of coupling portions 243 coupled to both ends of shaft 244, such that lock lever 283 pivots about shaft 244 between a position in which lock lever 283 covers the open end of case 280 and a position in which lock lever 283 does not cover the open end of case 280.

Lock lever 283 comprises a push-down member 242 which is integral with coupling portions 243. When lock lever 283 pivots, push-down member 242 also pivots in the same rotational direction as lock lever 283 pivots. Push-down member 242 is configured to push down a flange 144.

When lock lever 283 is opened, the open end of case 280 is uncovered. Ink cartridge 10 is selectively inserted into and removed from case 280 via the open end of case 280. When lock lever 283 pivots to the open end of case 280, lock lever 283 is locked to case 280 and covers the open end of case 280. Lock lever 283 comprises a release lever 282 positioned adjacent to an end of lock lever 283 opposite the end of lock lever 283 at which coupling portions 243 are positioned. When release lever 282 is operated, lock lever 283 is released from case 280.

Lock lever 283 comprises a push member 292 positioned at the inner surface of lock lever 283, and push member 292 extends from the inner surface of lock lever 283 in a direction perpendicular to the inner surface of lock lever 283. After ink cartridge 10 is inserted into case 280, when lock lever 283 is closed, push member 292 contacts rear wall 35 of housing 22 and pushes ink cartridge 10 toward the closed end of case 280, which completes the mounting of ink cartridge 10 to cartridge mounting portion 276.

Optical sensor 230 is positioned at the closed end of each case 280. Optical sensor 230 comprises the light emitting element and the light receiving element, and when ink cartridge 10 is inserted into case 280, translucent portion 140 and cover 220 pass through and/or are positioned in a space between the light emitting element and the light receiving element of optical sensor 230. The optical path of the light emitted from the light emitting element of optical sensor 230 and reaching the light receiving element of optical sensor 230 exists in the space between the light emitting element and the light receiving element of optical sensor 230. Optical sensor 230 is electrically connected to controller 200. Optical sensor 230 outputs an electric signal to controller 200 based on the intensity of light received by the light receiving element. In this embodiment, controller 200 determines whether ink cartridge 10 has a defect based on the signal from optical sensor 230 when cover 220 enters the optical path of optical sensor 230, and determines whether ink chamber 100 has a sufficient amount of ink therein based on the signal from optical sensor 230 when translucent portion 140 enters the optical path of optical sensor 230.

Limit switch 235 is positioned in an upper portion of each case 280 at a position facing inclined surface 122 of ink cartridge 10 when ink cartridge 10 is inserted into case 280. Limit switch 235 is electrically connected to controller 200, and limit switch 235 outputs an electric signal to controller 200. When inclined surface 122 moves underneath limit switch 235, inclined surface 122 pushes actuator 236 of limit switch 235, which causes the contacts of limit switch 235 to be electrically connected, such that a signal is outputted to controller 200. In this embodiment, controller 200 determines whether ink cartridge 10 has a defect based on the signal from limit switch 235.

Case 280 comprises a push portion 66 positioned at the closed end of each case 280. When ink cartridge 10 is inserted into case 280, push portion 66 contacts the end of rod 84. When ink cartridge 10 is further inserted into case 280, rod 84 is pushed into air communication valve mechanism 80 against the urging force of spring 86. This causes the path extending from the outside of frame 50 to ink chamber 100 via opening 82 to be opened.

Push rod 288 is positioned at the closed end of each case 280. Push rod 288 has a cylindrical hollow shape and extends toward the open end of case 280. When ink cartridge 10 is inserted into case 280, push rod 288 goes into ink supply opening 91 of ink supply valve mechanism 90.

A lock mechanism 130 is positioned at the bottom of each case 280, and lock mechanism 130 is configured to selectively limit and allow the movement of ink cartridge 10 into case 280 in insertion direction 30 in association with the position of lock lever 283.

Lock mechanism 130 comprises a base 131, a coil spring 137, and a slider 138. Slider 138 is coupled to base 131 via coil spring 137. Base 131 has a container shape having an opening at the top. Base 131 comprises a pair of hooks 134 positioned at an opposing pair of side walls of base 131, respectively. Case 280 has a pair of openings 247 formed through a pair of side walls of case 280, and the hooks 134 of base 131 are inserted into openings 247 of case 280 from the inside to the outside of case 280, such that lock mechanism 130 is attached to case 280.

Base 131 comprises a bottom wall and a cylindrical spring seat 136 extending from the bottom wall toward the inside of case 280. Spring seat 136 fits into loops of coil spring 137, such that a lower end of coil spring 137 is supported by spring seat 136.

Slider 138 comprises protrusion 132 positioned at an upper portion of slider 138 and extending upward toward the inside of case 280, a spring receiving chamber 143 positioned at a lower portion of slider 138, and flange 144 extending in a horizontal plane. Push-down member 242 is positioned directly above flange 144. Spring receiving chamber 143 has a cylindrical shape, and receives an upper end of coil spring 137. Slider 138 is resiliently supported by coil spring 137 accordingly, such that slider 138 selectively moves up and down.

Case 280 comprises a lower wall positioned at a lower portion of case 280, and the lower wall of case 280 contacts lower wall 37 of housing 22 when ink cartridge 10 is inserted into case 280. The lower wall of case 280 has an opening 248 formed therethrough. Slider 138 is configured to selectively move between a protruding position in which protrusion 132 protrudes from the lower wall of case 280 above the lower wall of case 280 via opening 248, and a retracting position in which protrusion 132 is retracted into opening 248 and does not protrude from the lower wall of case 280.

Lock mechanism 130 operates as follows. When lock lever 283 is opened and lies down, ink cartridge 10 is inserted into case 280. When this occurs, protrusion 132 of slider 138 being in the protruding position is inserted into guide groove 117 formed in lower wall 37 of housing 22. When ink cartridge 10 is further inserted into case 280, protrusion 132 contacts wall 118 bounding the end guide groove 117. This prevents further insertion of ink cartridge 10 in insertion direction 30.

Subsequently, lock lever 283 pivots, which causes push-down member 242 to contact and push down flange 144. When this occurs, slider 138 moves down against the urging force of coil spring 137. Coil spring 137 is compressed and slider 138 moves to the retracted position. Protrusion 132 is separated from wall 118 accordingly.

When lock lever 283 further pivots, push member 292 of lock lever 283 contacts rear wall 35 of housing 22 and pushes ink cartridge 10 in insertion direction 30. Because protrusion 132 no longer contacts wall 118, ink cartridge 10 moves to the closed end of case 280, and air communication valve mechanism 80 contacts push portion 66, and push rod 288 is inserted into ink supply valve mechanism 90. When lock lever 283 further pivots, housing 22 moves relative to case 280 toward the closed end of case 280 against the resilient force of coil spring 23 while main body 20 is stationary relative to case 280. Housing 22 moves relative to main body 20 while coil spring 23 is compressed. Subsequently, lock lever 283 is locked to case 280. Due to the urging force of coil spring 23, air communication valve mechanism 80 contacts push portion 66 securely, and push rod 288 is inserted into ink supply valve mechanism 90 securely.

Referring to FIGS. 8-11, the process in which ink cartridge 10 is inserted into case 280 is described in more detail. When ink cartridge 10 is inserted into case 280, protrusion 132 contacts wall 118 bounding the end guide groove 117, such that further insertion of ink cartridge 10 in insertion direction 30 is prevented. Subsequently, lock lever 283 pivots, such that the ink cartridge 10 is freed to move in insertion direction 30. When lock lever 283 further pivots, push member 292 of lock lever 283 contacts rear wall 35 of housing 22 and pushes ink cartridge 10 in insertion direction 30. When this occurs, cover 220 enters the optical path of optical sensor 230, as shown in FIG. 8, and blocks the light of optical sensor 230. As such, the cover 220 is detected by optical sensor 230.

Subsequently, when lock lever 283 further pivots to push ink cartridge 10 into case 280, inclined surface 122 moves underneath limit switch 235 and pushes actuator 236 of limit switch, as shown in FIG. 9, such that the contacts of limit switch 235 are electrically connected. As such, inclined surface 122 is detected by limit switch 235.

Subsequently, when lock lever 283 further pivots to push ink cartridge 10 into case 280, front face 41 of main body 20 reaches the closed end of case 280, as shown in FIG. 10, such that air communication valve mechanism 80 contacts push portion 66, and push rod 288 enters ink supply valve mechanism 90. When this occurs, cover 220 has passed the optical path of optical sensor 230, and translucent portion 140 has entered the optical path of optical sensor 230. Whether indication portion 72 exists in translucent portion 140 is detected by optical sensor 230, and controller 200 determines whether ink chamber 100 has a sufficient amount of ink therein based on the detection.

Subsequently, when lock lever 283 further pivots to push ink cartridge 10 into case 280, housing 22 moves relative to case 280 toward the closed end of case 280 against the resilient force of coil spring 23 while main body 20 is stationary relative to case 280. Lock lever 283 then is locked to case 280 to cover the open end of case 280, which completes the insertion of ink cartridge 10 into case 280. After the insertion is completed, main body 20 receives the urging force from coil spring 23 in insertion direction 30. The closed end of case 280 has a pair of openings 296 formed therethrough, and the openings 296 accommodate front ends of upper wall 36 and lower wall 37, respectively.

Referring to FIG. 12, controller 200 controls the operation of recording apparatus 250. Controller 200 is a micro computer comprising a central processing unit (CPU) 201, a read only memory (ROM) 202, a random access memory (RAM) 203, an electrically erasable programmable read only memory (EEPROM) 204, and an application specific integrated circuit (ASIC) 205.

ROM 202 stores a program used by CPU 201 for controlling the respective operations of recording apparatus 250, and a program for determining whether ink cartridge 10 has a defect. RAM 203 is a storage area or a work area for temporarily storing the respective data used by CPU 201 for executing the programs. EEPROM 204 stores settings, flags, or the like to be retained, even after the power is turned off.

Head controlling board 270, optical sensor 230, and limit switch 235 are coupled to ASIC 205. A drive circuit (not shown) for driving the respective rollers of feeding device 252 and transferring device 253, an input unit (not shown) for entering printing instruction or the like to recording apparatus 250, and a display device (not shown) for displaying information relating the recording apparatus 250, e.g., a Liquid Crystal Display (LCD) or Light Emitting Diode (LED), are connected to ASIC 205.

Head control board 270 controls recording head 272 based on the signals, e.g., control signal and image signal, supplied from ASIC 205. Accordingly, ink is selectively discharged at a predetermined timing from nozzles 274 of recording head 272.

Optical sensor 230 is configured to output an electric signal based on the quantity of light, e.g., the intensity of light, received by the light receiving element. For example, an analog electric signal, such as a voltage signal or current signal, is outputted from optical sensor 230 based on the intensity of light received by the light receiving element. The signal outputted from optical sensor 230 is supplied to controller 200, and controller 200 determines that the signal is a HIGH level signal when the electrical level, e.g., voltage value or current value, of the signal is greater than or equal to a predetermined threshold value, and determines that the signal is a LOW level signal when the electrical level is less than the threshold value. For example, it is determined that the signal is a LOW level signal when the optical path of optical sensor 230 is blocked, and that the signal is a HIGH level signal when the optical path of optical sensor 230 is not blocked.

Limit switch 235 is a mechanical switch configured to output a signal when actuator 236 moves, such that the contacts of limit switch 235 are electrically connected. The signal outputted from limit switch 235 is supplied to controller 200, and controller 200 determines that the limit switch 235 is ON when controller 200 receives the signal, and determines that the limit switch 235 is OFF when controller 200 does not receive the signal.

Figures 13A, 13B, 13C, 13D:
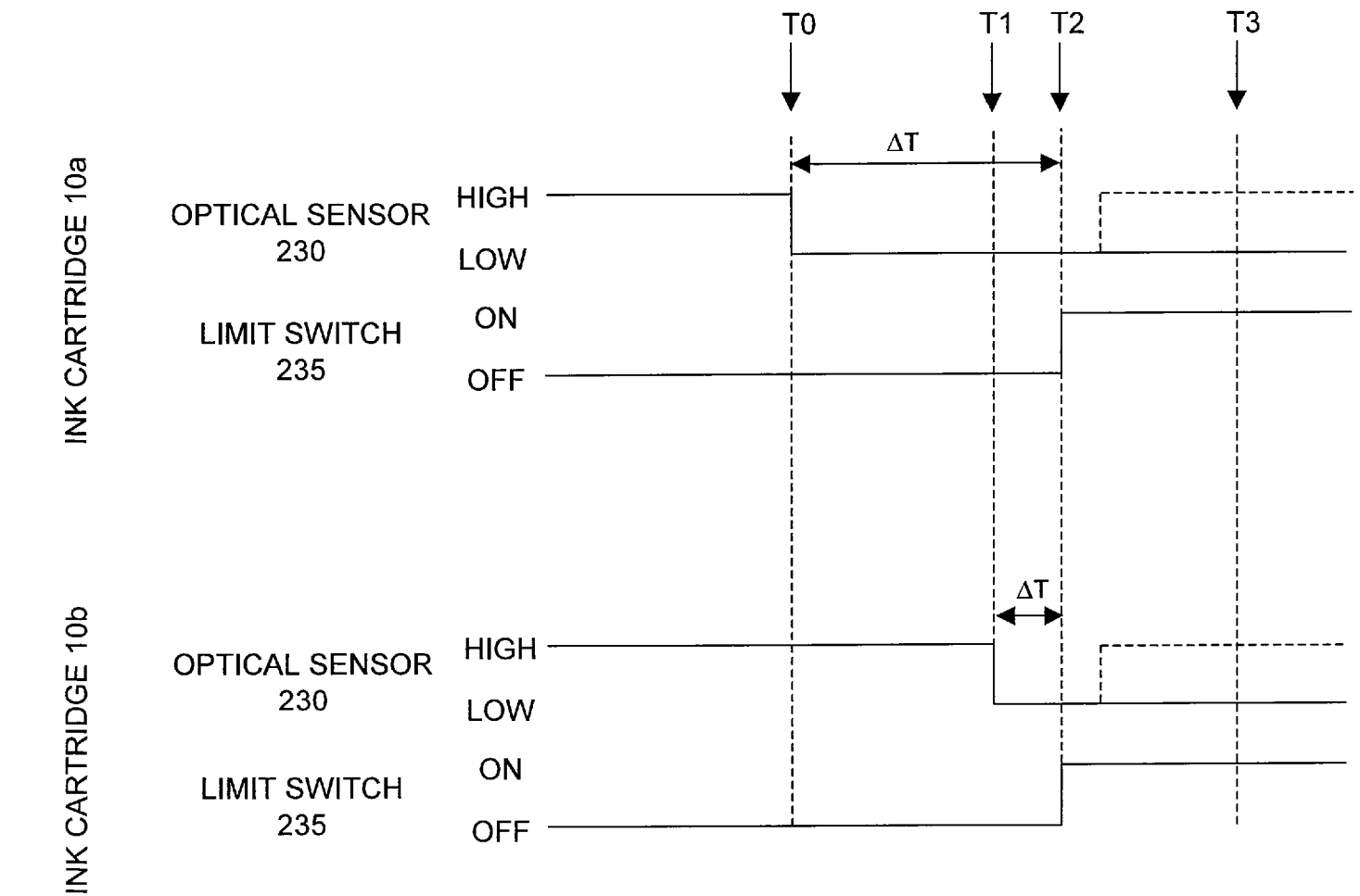
FIGS. 13(*a*) and 13(*b*) are an exemplary time profile of a signal level of a signal outputted the optical sensor and an exemplary time profile of an ON/OFF state of the limit switch, respectively, when a first ink cartridge is mounted to the cartridge mounting portion.

Referring to FIGS. 13(*a*) and 13(*b*), an exemplary time profile of the signal level of the signal outputted from optical sensor 230 and an exemplary time profile of the ON/OFF state of limit switch 235 when ink cartridge 10*a*, which does not include a defect, is inserted into case 280 are depicted, respectively. Referring to FIGS. 13(*c*) and 13(*d*), an exemplary time profile of the signal level of the signal outputted from optical sensor 230 and an exemplary time profile of the ON/OFF state of limit switch 235 when ink cartridge 10*b*, in which main body 20 bites into housing 22 while coil spring 23 is compressed, such that main body 20 and housing 22 do not move relative to each other, is inserted into case 280 are depicted, respectively.

As shown in FIGS. 13(*b*) and 13(*d*), the time profile of the ON/OFF state of limit switch 235 when ink cartridge 10*a* is inserted into case 280 is substantially the same as the time profile of the ON/OFF state of limit switch 235 when ink cartridge 10*b* is inserted into case 280, although the profile has a slight margin of error. Specifically, when inclined surface 122 of either of ink cartridge 10*a* or 10*b* moves underneath limit switch 235, the ON/OFF state of limit switch 235 changes from OFF to ON at a time T2. Controller 200 determines that inclined surface 122 is detected based on this change of the ON/OFF state from OFF to ON.

As shown in FIG. 13(*a*), when ink cartridge 10*a* is inserted into case 280, cover 220 enters the optical path of optical sensor 230, and therefore, the signal level of the signal outputted from optical sensor 230 changes from HIGH to LOW at a time T0. The time T0 is earlier than the time T2.

When the ink cartridge 10*a* is further inserted into case 280, cover 220 passes through the optical path of optical sensor 230, and then translucent portion 140 enters the optical path of optical sensor 230 between the time T2 and a time T3. By the time T3, insertion of ink cartridge 10*a* to case 280 is completed, and indication portion 72 is detected after the completion. In FIG. 13(*a*), the signal level when indication portion 72 is in the optical path of optical sensor 230 is represented by a solid line (LOW level), and the signal level when indication portion 72 is out of the optical path of optical sensor 230 is represented by a broken line (HIGH level).

As shown in FIG. 13(*c*), when ink cartridge 10*b* is inserted into case 280, cover 220 enters the optical path of optical sensor 230, and therefore, the signal level of the signal outputted from optical sensor 230 changes from HIGH to LOW. Nevertheless the time that the signal level changes from HIGH to LOW is not the time T0 but instead is the time T1 which is later than the time T0 because main body 20 bites into housing 22 while coil spring 23 is compressed, such that main body 20 and housing 22 do not move relative to each other. The time T1 is earlier than the time T2.

When the ink cartridge 10*b* is further inserted into case 280, cover 220 passes through the optical path of optical sensor 230, and then translucent portion 140 enters the optical path of optical sensor 230 between the time T2 and a time T3. By the time T3, insertion of ink cartridge 10*b* to case 280 is completed, and indication portion 72 is detected after the completion. In FIG. 13(*c*), the signal level when indication portion 72 is in the optical path of optical sensor 230 is represented by a solid line (LOW level), and the signal level when indication portion 72 is out of the optical path of optical sensor 230 is represented by a broken line (HIGH level).

In this embodiment, controller 200 calculates a time difference ΔT between when cover 220 is detected and when inclined surface 122 is detected, e.g., between T0 and T2, and between T1 and T2. Controller 200 determines whether ink cartridge 10 has a defect based on the time difference ΔT.

Figure 14:
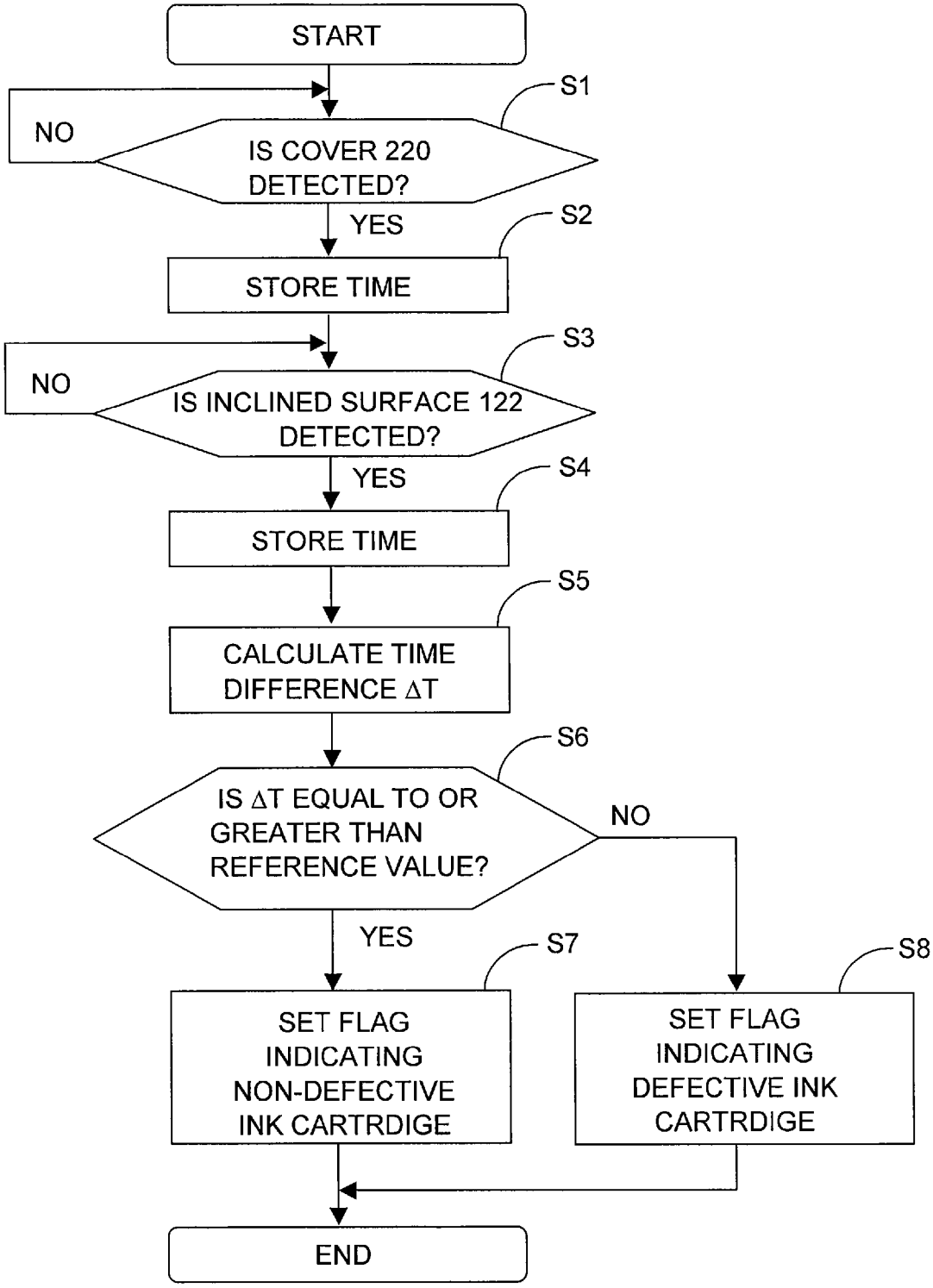
FIG. 14 is a flowchart of a procedure performed by the controller of the recording apparatus, according to an embodiment of the present invention.

Referring to FIG. 14, a procedure for determining whether ink cartridge 10 has a defect is depicted. In Step S1, controller 200 determines whether cover 220 is detected, e.g., controller 200 determines whether the signal lever of the signal outputted from optical sensor 230 changes from HIGH to LOW. When controller 200 determines that cover 220 is detected, the procedure goes to Step S2. In Step S2, the time when cover 220 is detected is stored in RAM 203. Step S1 repeats until cover 220 is detected.

Subsequently, in Step 3, controller 200 determines whether inclined surface 122 is detected, e.g., controller 200 determines whether the ON/OFF state of limit switch 235 changes from OFF to ON. When controller 200 determines that inclined surface 122 is detected, the procedure goes to Step S4. In Step S4, the time when inclined surface is detected is stored in RAM 203. Step S3 repeats until inclined surface 122 is detected.

Subsequently, in Step 5, controller 200 calculates the time difference ΔT based on the times stored in RAM 203. The time difference ΔT is then compared to a reference value to determine whether the time difference ΔT is greater than or equal to +the reference value in step S6. In this embodiment, the reference value was set based on statistics corresponding to the time difference ΔT when an ink cartridge which does not include a defect is inserted into case 280, and statistics corresponding to the time difference ΔT when an ink cartridge including a defect is inserted into case 280. The reference value is stored in RAM 203 in advance. Alternatively, it may be determined whether the time difference ΔT is within or outside a predetermined range in Step 6.

Ink cartridge 10 may include a defect. For example, when ink cartridge 10 contacts a surface, the impact of the contact may cause main body 20 to bite into housing 22. Coil spring 23 inadvertently may be omitted when ink cartridge 10 is assembled, or a defective coil spring 23 may be loaded into ink cartridge 10 when ink cartridge 10 is assembled. When such a defective ink cartridge 10 is inserted into case 280, the time when cover 220 is detected may be delayed, such that the time difference ΔT is less than the time difference ΔT when an ink cartridge 10 which does not include a defect is inserted into case 280. Therefore, in this embodiment, if it is determined in Step S6 that the time difference ΔT is less than the reference value, a bit flag indicating that ink cartridge 10 has a defect is set to a register of CPU 201 or RAM 203 in Step S8. If it is determined in Step S6 that the time difference ΔT is greater than or equal to the reference value, a bit flag indicating that ink cartridge 10 does not include a defect is set to a register of CPU 201 or RAM 203 in Step S7.

If the bit flag is set, recording apparatus 250 or an information processing apparatus e.g. a personal computer connected to recording apparatus 250, may display whether ink cartridge 10 has a defect or not, based on the flag.

As such, according to an embodiment of the present invention, whether ink cartridge 10 has a defect is determined when ink cartridge 10 is inserted into case 280. Even when it is difficult to recognize that ink cartridge 10 has a defect from the appearance of ink cartridge 10, whether ink cartridge 10 has a defect is determined.

Information indicating whether ink cartridge 10 has a defect is displayed. Therefore, a user may notice that ink cartridge 10 has a defect before the user uses recording apparatus 250.

In the embodiment described above, cover 220 enters the optical path of optical sensor 230 before inclined surface 122 pushes actuator 236 of limit switch 235. In another embodiment, cover 220 may enter the optical path of optical sensor 230 after inclined surface 122 pushes actuator 236 of limit switch 235. In this case, the time difference ΔT when ink cartridge 10 including a defect is inserted into case 280 becomes longer compared to when ink cartridge 10 having no defect is inserted into case 280. Therefore, if it is determined in Step S6 that the time difference ΔT is less than the reference value, a bit flag indicating that ink cartridge 10 does not include a defect is set to a register of CPU 201 or RAM 203, and if it is determined in Step S6 that the time difference ΔT is equal to greater than the reference value, a bit flag indicating that ink cartridge 10 has a defect is set to a register of CPU 201 or RAM 203.

In the embodiment described above, inclined surface 122 is positioned at the front end of upper wall 36, and limit switch 235 is positioned in an upper portion of case 280 at a position facing inclined surface 122 when ink cartridge 10 is inserted into case 280. In another embodiment, inclined surface 122 may be positioned at the front end of lower wall 37, and limit switch 235 may be positioned at a lower portion of case 280 at a position facing inclines surface 122 when ink cartridge is inserted into case 280.

In the embodiment described above, whether ink cartridge 10 has a defect is determined in recording apparatus 250. In another embodiment, whether ink cartridge 10 has a defect may be determined in a particular device which does not have any recording functions, but only performs the determination. Such a particular device may be used in a production line of ink cartridge 10.

In the embodiment described above, whether ink cartridge 10 is appropriate, e.g., whether ink cartridge 10 has a defect, is determined. In another embodiment, whether a liquid cartridge, which may store liquid fuel, biological, etc, is appropriate, e.g., whether t or not he liquid cartridge has a defect, may be determined.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

The invention claimed is:

1. A liquid cartridge determination system, comprising:

a liquid cartridge comprising:

a main body having a liquid chamber defined therein, wherein the liquid chamber is configured to store liquid therein, and the main body comprises a first detect portion;

a movable member positioned outside the liquid chamber and configured to move relative to the main body in a particular direction, wherein the movable member comprises a second detect portion; and a resilient member having a first end which is coupled to the main body and a second end which is coupled to the movable member;

a mounting portion configured to receive the liquid cartridge thereon, wherein the liquid cartridge is configured to be inserted into the mounting portion in the particular direction;

a first detector configured to detect the first detect portion when the liquid cartridge is positioned in a first position relative to the mounting portion, and to generate a first signal when the first detector detects the first detect portion;

a second detector configured to detect the second detect portion when the liquid cartridge is positioned in a second position relative to the mounting portion, wherein the first position is different than the second position, and to generate a second signal when the second detector detects the second detect portion; and a determiner configured to determine whether the liquid cartridge has at least one predetermined characteristic associated therewith based on a time difference between a first time when the first signal is generated by the first detector from detecting the first detect portion and a second time when the second signal is generated by the second detector from detecting the second detect portion.

2. The liquid cartridge determination system of claim 1, wherein the liquid cartridge has the at least one predetermined characteristic associated therewith when the time difference is outside a predetermined range of time.

3. The liquid cartridge determination system of claim 1, wherein the liquid cartridge has the at least one predetermined characteristic associated therewith when the time difference is less than a predetermined value.

4. The liquid cartridge determination system of claim 1, wherein the main body further comprises:

a front face, wherein the first detect portion is positioned at the front face; and a rear face opposite the front face, wherein the first end of the resilient member is coupled to the rear face, and the movable member further comprises:

a rear wall covering the rear face, wherein the second end of the resilient member is coupled to the rear wall; and a particular wall having a first end which is connected to the rear wall and a second end opposite the first end of the particular wall, wherein the particular wall extends from the first end of the particular wall to the second end of the particular wall in the particular direction, and the second detect portion is positioned at the second end of the particular wall.

5. The liquid cartridge determination system of claim 4, wherein the main body further comprises:

a top face connected to the front face and the rear face;

a bottom face opposite the top face, wherein the bottom face is connected to the front face and the rear face; and a pair of side faces, each connected to the front face, the rear face, the top face, and the bottom face, and the movable member further comprises:

a further wall opposite the particular wall, wherein the further wall is connected to the rear wall, one of the particular wall and the further wall covers at least a portion of the top face, and the other of the particular wall and the further wall covers at least a portion of the bottom face; and a pair of side walls each connected to the rear wall, the particular wall, and the further wall, wherein the pair of side walls covers at least a portion of the pair of side faces, respectively.

6. The liquid cartridge determination system of claim 1, wherein the resilient member is configured to selectively contract and expand to move the movable member relative to the main body in the particular direction and in a further direction opposite the particular direction, respectively.

7. The liquid cartridge system of claim 1, wherein the at least one predetermined characteristic comprises at least one defect associated with the liquid cartridge.

8. A liquid cartridge determination method, comprising the steps of:

detecting a first detect portion of a main body of an liquid cartridge when the liquid cartridge is positioned in a first position relative to a mounting portion to which the liquid cartridge is mounted and generating a first signal when the first detect portion is detected, wherein the main body has a liquid chamber defined therein, and the liquid chamber is configured to store liquid therein;

detecting a second detect portion of a movable member of the liquid cartridge when the liquid cartridge is positioned in a second position relative to the mounting portion and generating a second signal when the second detect portion is detected, wherein the movable member is coupled to the main body via a resilient member, and the first position is different than the second position; and determining whether the liquid cartridge has at least one predetermined characteristic associated therewith based on a time difference between a first time when the first signal is generated from detecting the first detect portion and a second time when the second signal is generated from detecting the second detect portion.

9. The liquid cartridge determination method of claim 8, wherein the liquid cartridge has the at least one predetermined characteristic associated therewith when the time difference is outside a predetermined range of time.

10. The liquid cartridge determination method of claim 8, wherein the liquid cartridge has the at least one predetermined characteristic associated therewith when the time difference is less than a predetermined value.

11. The liquid cartridge determination method of claim 8, wherein the at least one predetermined characteristic comprises at least one defect associated with the liquid cartridge.

12. The liquid cartridge determination system of claim 1, wherein the first detector and the second detector are positioned at the mounting portion.

* * * * *